US009782990B2

(12) United States Patent
Yamanaka et al.

(10) Patent No.: US 9,782,990 B2
(45) Date of Patent: Oct. 10, 2017

(54) PRINTER

(71) Applicant: SATO HOLDINGS KABUSHIKI KAISHA, Tokyo (JP)

(72) Inventors: Osamu Yamanaka, Saitama (JP); Takehiko Yokozawa, Kanagawa (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/311,290

(22) PCT Filed: Apr. 8, 2015

(86) PCT No.: PCT/JP2015/060949

§ 371 (c)(1),
(2) Date: Nov. 15, 2016

(87) PCT Pub. No.: WO2016/027500

PCT Pub. Date: Feb. 25, 2016

(65) Prior Publication Data

US 2017/0072723 A1 Mar. 16, 2017

(30) Foreign Application Priority Data

Aug. 18, 2014 (JP) ..... 2014-165847

(51) Int. Cl.
*B41J 29/13* (2006.01)
*B41J 29/02* (2006.01)
(Continued)

(52) U.S. Cl.
CPC ..... *B41J 29/02* (2013.01); *B41J 11/0045* (2013.01); *B41J 11/04* (2013.01); *B41J 15/04* (2013.01); *B41J 29/13* (2013.01)

(58) Field of Classification Search
CPC ..... B41J 29/026; B41J 29/023; B41J 29/02; B41J 29/00; B41J 15/044; B41J 3/4075; B41J 32/00; B41J 29/13
See application file for complete search history.

(56) References Cited

U.S. PATENT DOCUMENTS

2011/0211034 A1 9/2011 Katayama
2012/0257222 A1* 10/2012 Jiang ..... B41J 29/02 358/1.5

(Continued)

FOREIGN PATENT DOCUMENTS

JP 2001-063160 A 3/2001
JP 2008-062597 A 3/2008

(Continued)

*Primary Examiner* — Kristal Feggins
(74) *Attorney, Agent, or Firm* — Foley & Lardner LLP

(57) ABSTRACT

An inner cover disposed on the underside of the free end of an open and closing cover that opens and closes a print medium container of a printer includes a protruding head having thickness is gradually narrower in the direction away from a platen roller. On said protruding head, a protruding part is disposed on a first surface opposing an adhesive layer during feeding a continuous label faces. The protruding part is adjacent to a portion of the outer circumference of the platen roller. A first rib is disposed on the surface of the protruding part. The first rib has a function of separating the continuous label from the outer circumference of the platen roller during back-feeding.

20 Claims, 17 Drawing Sheets

(51) Int. Cl.

| | |
|---|---|
| ***B41J 11/04*** | (2006.01) |
| ***B41J 15/04*** | (2006.01) |
| ***B41J 11/00*** | (2006.01) |

(56) References Cited

U.S. PATENT DOCUMENTS

| | | | | |
|---|---|---|---|---|
| 2013/0164071 | A1* | 6/2013 | Matsuya | B41J 29/13 400/621 |
| 2014/0186087 | A1* | 7/2014 | Aizawa | B41J 29/13 400/621 |

FOREIGN PATENT DOCUMENTS

| | | | |
|---|---|---|---|
| JP | 2011-031426 | A | 2/2011 |
| JP | 2011-037231 | A | 2/2011 |
| JP | 2013-215899 | A | 10/2013 |

* cited by examiner

PRINTER

TECHNICAL FIELD

The present invention relates to a printer, for instance, a label printer configured to print desired information such as a character, a sign, a diagram, a bar code or so forth on a label continuous body.

BACKGROUND

A label printer is a type of printer exclusively for label printing. For example, the label printer is configured to rotate a platen roller to feed a label continuous body wound in a roll shape pinched at one end thereof between the platen roller and a thermal head, whereby printing the intended information on the label continuous body.

For example, Japan Laid-open Patent Application Publication No. 2008-62597 describes this type of label printer that a platen roller is rotatably disposed on a free end of an opening and closing cover for closing and opening a container of a label continuous body, and a thermal head is disposed on the interior of the label printer so as to face the thermal head when the opening and closing cover is set in a closed state.

SUMMARY OF THE INVENTION

Technical Problem

There is a type of label continuous body made in the form of a strip of continuous labels that does not include a liner but includes an adhesive agent layer on one surface thereof (linerless labels). In use of the linerless labels, the adhesive agent layer thereof is exposed. Hence, a part of a label printer, making contact with the adhesive agent layer, is made of non-adhesive material or is processed with non-adhesive treatment, whereby the linerless labels are prevented from easily sticking to the part.

However, in back feeding, which is a motion to feed the linerless labels reversely to a print feeding direction, the linerless labels are fed from a position corresponding to the thermal head to the upstream side in the print feeding direction while slightly sticking to the outer periphery of the platen roller. At this time, there are chances that the linerless labels are drawn into a gap between the platen roller and the opening and closing cover. Consequently, the linerless labels stick to the end of the opening and closing cover, and jam of the linerless labels occurs. Especially, such sticking-related jam easily occurs when the linerless labels are interposed and held between the thermal head and the platen roller for a long period of time.

The present invention has been made in view of the aforementioned technical background, and is intended to provide a technology whereby when a printer performs back feeding of a print medium including an adhesive agent layer on one surface thereof, the print medium can be prevented from sticking to an inner wall surface located upstream of a feed roller in a print feeding direction.

Solution to Problem

A printer according to a first aspect of the present invention includes a housing, a print medium container, an opening and closing cover, a feed roller, a print head, a protruding head, a protruding part, and a first ridge part. The print medium container is disposed in the housing and is configured to accommodate a print medium including an adhesive agent layer on one surface thereof. The opening and closing cover is pivotably supported by the housing, and is configured to open and close the print medium container. The feed roller is rotatably disposed on a free end of the opening and closing cover and is configured to feed the print medium. The print head is disposed to face the feed roller in the housing and is configured to print on the print medium. The protruding head is disposed on the free end of the opening and closing cover. The thickness of the protruding head gradually reduces in a separating direction from the feed roller. The protruding head includes a first surface, a second surface and a connecting part. The first surface opposes an adhesive agent layer of the print medium when the print medium is fed from the print medium container toward the feed roller in a closed state of the opening and closing cover. The second surface is adjacent to the print medium container in the closed state of the opening and closing cover. The connecting part is disposed on a tip of the protruding head and connects the first surface and the second surface. The protruding part is disposed on a feed roller side end of the first surface and protrudes in an intersecting direction with the first surface to face the feed roller. The first ridge part protrudes from a surface of the protruding part.

In a printer according to a second aspect of the present invention, a second ridge part may be disposed on the first surface of the protruding head and protrude therefrom. The second ridge part may extend in an intersecting direction with a lengthwise direction of the feed roller to continuously connect to the first ridge part.

In a printer according to a third aspect of the present invention, the second ridge part may end in a position between the feed roller and the connecting part. A third ridge part may be disposed on the first surface, protrude therefrom and is located on a side close to the connecting part away from the second ridge part on an extension of the second ridge part.

In a printer according to a fourth aspect of the present invention, a fourth ridge part may be disposed on the connecting part and protrude from a surface thereof.

In a printer according to a fifth aspect of the present invention, a fifth ridge part may be disposed on the second surface and protrude therefrom.

In a printer according to a sixth aspect of the present invention, the protruding head of the opening and closing cover may be integrally provided with a holding part configured to hold the feed roller.

In a printer according to a seventh aspect of the present invention, the housing may include a feed member that faces the first surface and being configured to form a feeding path for the print medium in the closed state of the opening and closing cover. The feed member may include a sixth ridge part on a surface thereof that faces the first surface. The sixth ridge part may protrude from a position that is adjacent to the first ridge part on the surface of the feed member.

In a printer according to an eighth aspect of the present invention, the housing may include a feed member and a pair of guide members. The feed member may face the first surface and be configured to form a feeding path for the print medium in the closed state of the opening and closing cover. The pair of guide members may be disposed inside the print medium container and be configured to guide a position of the print medium in a width direction. A gear member may be rotatably disposed on the feed member. The gear member may be configured to move one of the pair of guide members when the other of the pair of guide members is moved in the width direction of the print medium.

Advantageous Effects

According to the first aspect of the present invention, in back feeding of the print medium including the adhesive agent layer on one surface thereof; the print medium can be separated from the feed roller by the first ridge part. Hence, the print medium can be prevented from sticking to an inner wall surface located upstream of the feed roller in a feeding direction.

According to the second aspect of the present invention, in print feeding, even when the print medium approaches to the first surface in some operating situations, the adhesive agent layer of the print medium is allowed to makes contact with only a lesser number of parts. It is thus possible to reduce contact resistance occurring when the adhesive agent layer makes contact with the first surface. Hence, it is possible to inhibit or prevent occurrence of printing defects attributed to this contact of the adhesive agent layer. Additionally, in print feeding and back feeding of the print medium, the adhesive agent layer of the print medium can be inhibited or prevented from sticking to the first surface. Hence, it is possible to inhibit or prevent occurrence of jam attributed to this sticking of the adhesive agent layer.

According to the third aspect of the present invention, in print feeding, even when the print medium approaches to the first surface in some operating situations, the adhesive agent layer of the print medium is allowed to limitedly make contact with the first ridge part, the second ridge part and the third ridge part. It is thus possible to reduce contact resistance occurring when the adhesive agent layer makes contact with the first surface. Hence, it is possible to inhibit or prevent occurrence of printing defects attributed to this contact of the adhesive agent layer. Additionally, in print feeding and back feeding of the print medium, the adhesive agent layer of the print medium can be inhibited or prevented from sticking to the first surface. Hence, it is possible to inhibit or prevent occurrence of jam attributed to this sticking of the adhesive agent layer. Moreover, with the construction that the second ridge part and the third ridge part are spaced apart from each other, it is also possible to reduce the area that the adhesive agent layer of the print medium makes contact with the second ridge part and the third ridge part in back feeding of the print medium. Hence, it is possible to further enhance performance of feeding the print medium in back feeding.

According to the fourth aspect of the present invention, the adhesive agent layer of the print medium is allowed to limitedly make contact with the fourth ridge part on the connecting part. It is thus possible to reduce contact resistance occurring when the adhesive agent layer of the print medium makes contact with the connecting part in print feeding. Hence, it is possible to inhibit or prevent occurrence of printing defects attributed to this contact of the adhesive agent layer. Additionally, in print feeding of the print medium, the adhesive agent layer of the print medium can be inhibited or prevented from sticking to the connecting part. Hence, it is possible to inhibit or prevent occurrence of jam attributed to this sticking of the adhesive agent layer.

According to the fifth aspect of the present invention, the outer periphery of the print medium is allowed to make contact with only a lesser number of parts of the second surface when the print medium rotates within the print medium container. Hence, it is possible to reduce frictional resistance occurring in rotation of the print medium.

According to the sixth aspect of the present invention, the printer can be produced in smaller size than a construction that a member for holding the feed roller is separately disposed.

According to the seventh aspect of the present invention, it is possible to match the position of a trace formed on the print medium by the contact with the first ridge part and that of a trace formed on the print medium by the contact with the sixth ridge part. Hence, compared to a construction that the first ridge part and the sixth ridge part are displaced without facing each other, it is possible to reduce the number of lines left as traces of the ridge parts on the print medium.

According to the eighth aspect of the present invention, the printer can be produced in smaller size than a construction that the gear member is disposed on the bottom surface inside the housing.

DESCRIPTION OF EMBODIMENTS

Figure 1A:
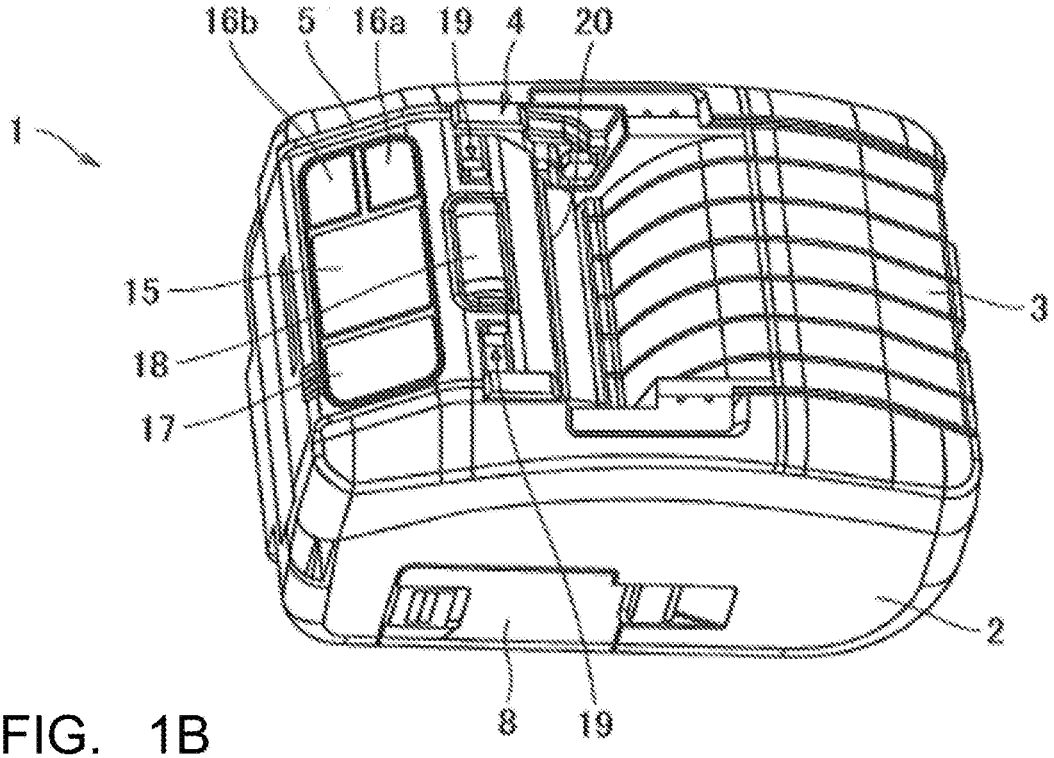
FIG. 1A is an entire perspective view of a printer according to an exemplary embodiment of the present invention in a normal ejection mode.

This application claims priority to Japanese Patent Application No. 2014-165847 filed on Aug. 18, 2014, the entirety of which is hereby incorporated by reference in its entirety.

Based on drawings, an exemplary embodiment will be hereinafter explained in detail as an example of the present invention. In principle, the same constituent elements will be denoted by the same reference sign in the drawings for explaining the exemplary embodiment, and will not be explained repeatedly. Terms in the exemplary embodiment will be briefly explained as follows. The term "feeding" refers to a motion to feed a label continuous body (print medium) for a printing purpose. The term "feeding direction" (print feeding direction) refers to a direction in which the label continuous body is fed for a printing purpose, and specifically, a direction that the label continuous body is fed from a paper supplying part to a thermal head. The term "back feeding" refers to a motion to feed the label continuous body reversely to the feeding direction after printing of desired information on a desired label of the label continuous body whereby the other labels are reversely shifted such that the label next to the desired label is returned to a print starting position. The term "back feeding direction" refers to a direction in which the label continuous body is fed for a back feeding purpose, and specifically, a direction that the label continuous body is fed from a thermal head side to a paper supplying part side. The terms "separation ejection" and "normal ejection" are defined on the premise that "labels with a liner", including a long strip of liner and a plurality of continuous labels temporarily attached to the liner at predetermined intervals, are used in a printer as a label continuous body. The term "separation ejection" refers to an ejection mode configured to eject the labels from the printer while the labels are separated from the liner one by one. On the other hand, the term "normal ejection" refers to an ejection mode configured to eject the labels from the printer without separating the labels from the liner. The normal ejection is applied not only to a situation that labels with a liner are ejected without separating the labels from the liner but also to a situation that other types of linerless labels used as a label continuous body are ejected. These other types of linerless labels include a strip of continuous labels without a liner and is configured to be fed while an adhesive agent layer on one surface thereof is exposed, a continuously produced sheet (continuous sheet) without a liner and does not include any adhesive agent layer thereon, and so forth.

Figure 1B:
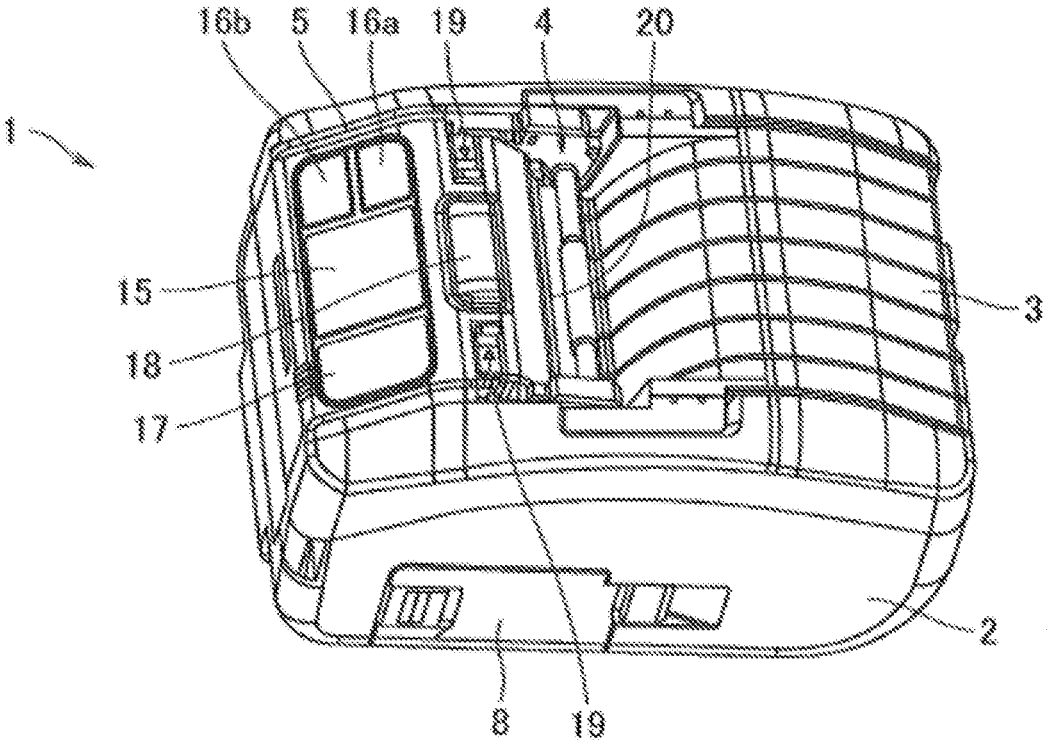
FIG. 1B is an entire perspective view of the printer shown in FIG. 1A in a separation ejection mode.
Figure 2:
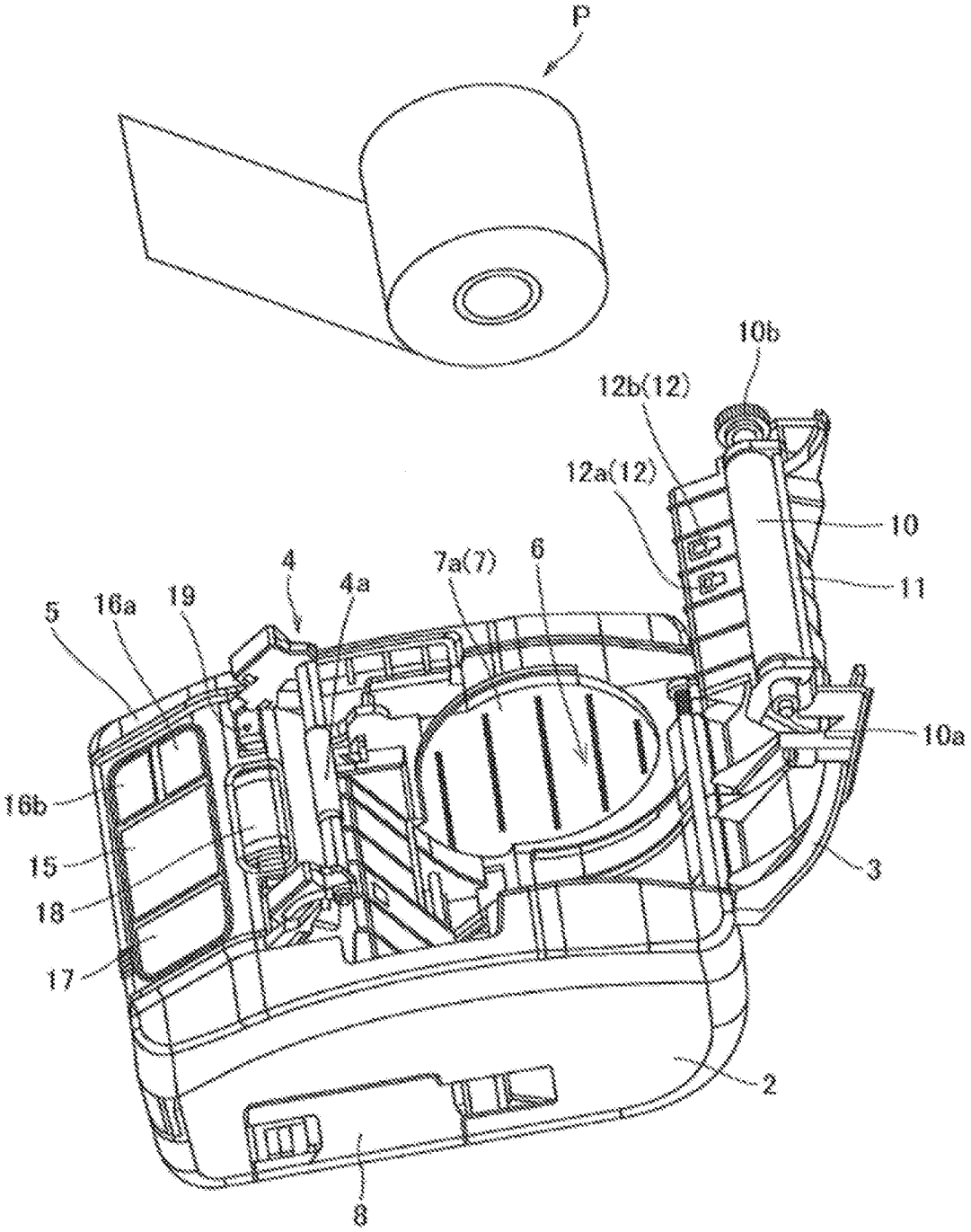
FIG. 2 is an entire perspective view of the appearance of a label continuous body and the printer shown in FIGS. 1A and 1B in an opened state of an opening and closing cover.

FIG. 1A is an entire perspective view of a printer according to the present exemplary embodiment in a normal ejection mode. FIG. 1B is an entire perspective view of the printer shown in FIG. 1A in a separation ejection mode. FIG. 2 is an entire perspective view of the appearance of a label continuous body and the printer shown in FIGS. 1A and 1B in an opened state of an opening and closing cover.

As shown in FIGS. 1A and 1B, a printer 1 according to the present exemplary embodiment is a portable label printer made in a flat cuboid shape, for instance. The printer 1 includes a body case 2, an opening and closing cover 3, a separation unit 4 and a front cover 5 (exemplary housing). The printer 1 is of a dual mode type configured to be capable of switching between normal ejection and separation ejection by itself. The printer 1 is not only usable with an ejection port facing upwards (in horizontal installation), but also usable with the ejection port facing sideward (in a vertical installation) by hooking a belt hook (not shown in the drawings) disposed on the bottom surface of the printer 1 on a belt of a worker or by attaching a shoulder belt (not shown in the drawings) to the printer 1 and then hanging the shoulder belt on the shoulder of the worker.

The body case 2 is a housing that composes part of the contour of the printer 1. As shown in FIG. 2, the body case 2 includes a paper container 6 (exemplary print medium container) built in the interior thereof. The paper container 6 is a region for accommodating a label continuous body P wound in a roll shape. A pair of guide plates 7*a* (exemplary guide members) of a paper guide mechanism 7 is disposed in the interior of the paper container 6. The paper guide mechanism 7 is a mechanism for supporting and guiding the label continuous body P in accordance with its width. As shown in FIGS. 1A to 2, a battery cover 8 is pivotably supported by one of the lateral surfaces of the body case 2 so as to take an opened position or closed position.

As shown in FIG. 2, the label continuous body P is, for instance, a strip of continuous labels (linerless labels) without a liner and includes an adhesive agent layer on one surface thereof and a release agent layer on the other surface thereof. The label continuous body P wound in a roll shape is accommodated in the paper container 6. Location detection marks (not shown in the drawings) to indicate the locations of the labels are disposed on the adhesive agent side of the label continuous body P while being aligned along the lengthwise direction of the label continuous body P at predetermined intervals. A thermosensitive color developing layer is disposed on the front surface (located on the back side of the surface on which the adhesive agent layer is disposed, and is also referred to as a printing surface) of the label continuous body P. The thermosensitive color developing layer is configured to turn a predetermined color (black, red, etc.) when reaching a predetermined temperature range.

The opening and closing cover 3 is an opening and closing cover for closing and opening the paper container 6. One lengthwise end of the opening and closing cover 3 (free end: lengthwise middle of the body case 2) is movable in directions separating from and approaching to the body case 2, while the other lengthwise end thereof is pivotably supported by an opening and closing support shaft disposed on one lengthwise end of the body case 2. The opening and closing cover 3 is biased in an opening direction (a direction in which the free end of the opening and closing cover 3 separates from the body case 2) by a torsion spring disposed on the opening and closing support shaft provided on the other lengthwise end thereof.

A platen roller 10 (exemplary feed roller) is rotatably supported by the free end of the opening and closing cover 3 so as to rotate in normal and reverse directions. The platen roller 10 is a feeder configured to feed the label continuous body P. The platen roller 10 extends along the width direction (short-side direction) of the label continuous body P. The platen roller 10 is made of, for instance, non-adhesive material such as silicone-contained resin or silicone rubber in order to prevent the adhesive agent of the label continuous body P from sticking thereto. A gear 10*b* is connected to one end of a platen roller shaft 10*a* of the platen roller 10. When the opening and closing cover 3 is set in a closed state, the gear 10*b* is configured to be engaged with a gear and so forth (not shown in the drawings) disposed on the interior of the body case 2, and be mechanically connected to a stepping motor for roller driving (not shown in the drawings) and so forth through the gear and so forth.

A separation pin 11 is disposed on the free end of the opening and closing cover 3 along and in the vicinity of the platen roller 10. The separation pin 11 is a separation member and is supported at the both lengthwise ends thereof by the opening and closing cover 3. When labels with a liner are used as a label continuous body, the separation pin 11 is configured to separate the labels from the liner.

A sensor 12 is disposed on a surface of a free end-side part of the opening and closing cover 3. This surface opposes the label continuous body P. The sensor 12 is configured to detect the locations of the labels (the aforementioned location detection marks) of the label continuous body P. The sensor 12 is, for instance, a reflective photosensor or so forth. The sensor 12 includes a light emitter 12*a* and a light receiver 12*b*.

When labels with a liner are used as the label continuous body P, the separation unit 4 is configured to separate labels from the liner of the label continuous body P in separation ejection, and then divide a feeding path for the label continuous body P into a feeding path for the liner and that for the labels. The separation unit 4 is disposed such that a nip roller 4*a* on the lengthwise tip thereof can be moved to a normal ejection position located inside the printer 1 and a separation ejection position located outside the printer 1. The nip roller 4*a* is disposed so as to face the platen roller 10 in separation ejection. The nip roller 4*a* is configured to feed the liner inserted between the nip roller 4*a* and the platen roller 10 with the liner being pinched therebetween. The nip roller 4*a* is configured to rotate in conjunction with rotation of the platen roller 10.

The front cover 5 is fixed to the body case 2 and composes part of the housing of the printer 1. On the surface of the body case 2, the front cover 5 covers a region that is adjacent to the opening and closing cover 3 and parts of the body case 2 that are located in the vicinity of the both lateral surfaces of the body case 2. The front cover 5 includes a display 15, operating buttons 16*a* and 16*b*, an electric power button 17, a cover open button 18, a pair of release levers 19 and a cutter 20.

The display 15 is a screen configured to display an operating command, a message and so forth. The display 15 is, for instance, an LCD (Liquid Crystal Display). The operating buttons 16*a* and 16*b* are buttons configured to operate the motion and setting of the printer 1. The electric power button 17 is a button configured to turn on and off the electric power supply of the printer 1. The cover open button 18 is a button configured to open the opening and closing cover 3. The release levers 19 are configured to hold the separation unit 4 in the normal ejection position. When the release levers 19 are moved to approach each other, the holding of the separation unit 4 is releasable. The cutter 20 is configured to cut the label continuous body P that has been ejected in normal ejection. The cutter 20 is disposed on the tip of a part of the front cover 5, i.e., the tip of a part that is adjacent to the opening and closing cover 3, while extending from end to end of the tip in the short-side direction of the printer 1 (the axial direction of the platen roller 10). An ejection port is produced between the opening and closing cover 3 and the front cover 5.

Figure 3A:
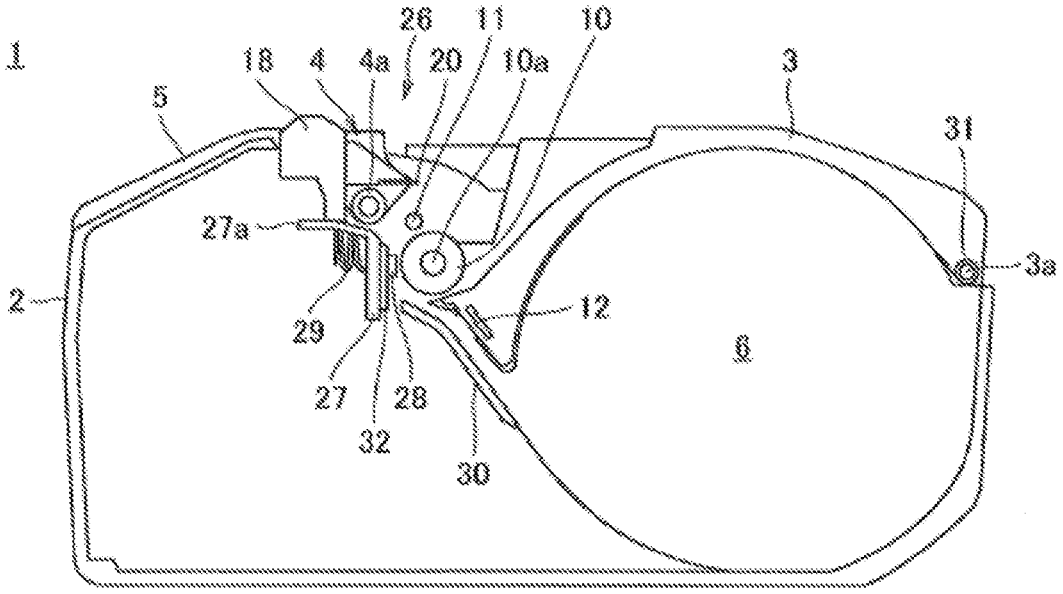
FIG. 3A is a schematic configuration diagram of the printer shown in FIG. 1A in normal ejection.
Figure 3B:
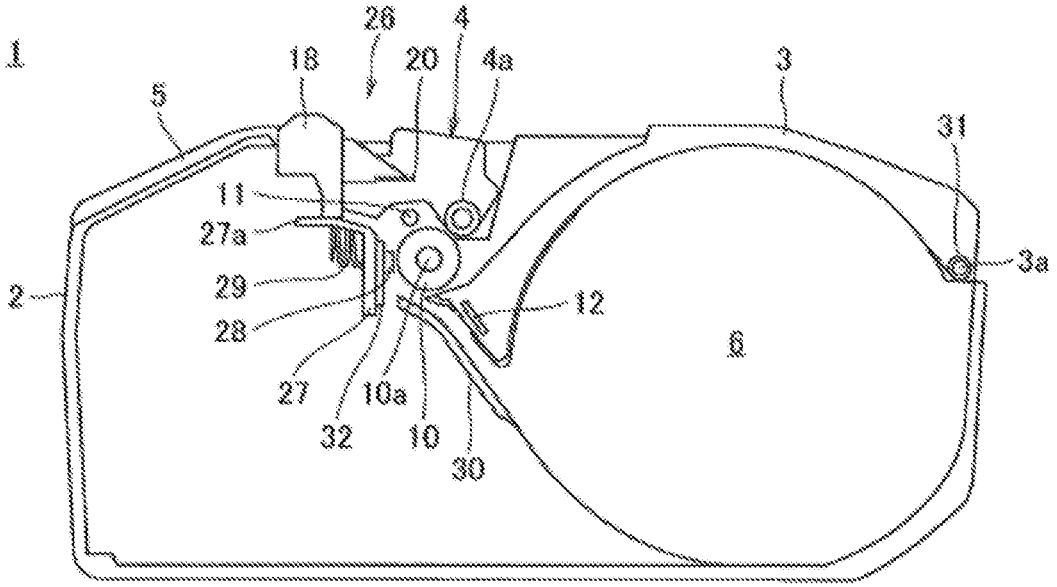
FIG. 3B is a schematic configuration diagram of the printer shown in FIG. 1B in separation ejection.

The internal structure of the printer 1 will be explained with reference to FIGS. 3A and 3B. FIG. 3A is a schematic configuration diagram of the printer shown in FIG. 1A in normal ejection. FIG. 3B is a schematic configuration diagram of the printer shown in FIG. 1B in separation ejection.

A head bracket 27, a thermal head 28 (exemplary print head), a coil spring 29, the separation unit 4, a feed plate 30 (exemplary feed member) and a battery container (not shown in the drawings) are installed adjacently to each other in the interior of the body case 2 while facing the paper container 6 and the platen roller 10.

The head bracket 27 is configured to hold the thermal head 26 and the opening and closing cover 3 that is set in the closed state. The head bracket 27 is disposed so as to swing while facing the platen roller 10 when the opening and closing cover 3 is set in the closed state. When the platen roller shaft 10*a* of the platen roller 10 is fitted into a groove that is formed on the head bracket 27, the opening and closing cover 3 is held by the head bracket 27. The head bracket 27 is integrally provided with a press part 27*a*. The press part 27*a* is located in a position (immediately below) that is adjacent to the cover open button 18. When the cover open button 18 is pressed, the press part 27*a* is also pressed and swings, and thereby the holding of the opening and closing cover 3 by the head bracket 27 is released. When the holding of the opening and closing cover 3 is released, the opening and closing cover 3 is automatically opened by a biasing force of a torsion spring 31 disposed on an opening and closing support shaft 3*a* on the other lengthwise end thereof.

The thermal head 28 is printing means configured to print information, for instance, a character, a sign, a diagram, a bar code or so forth on the label continuous body P. The thermal head 28 is disposed on the head bracket 27 through a circuit board 32 while a printing surface thereof opposes a paper path. The thermal head 28 is adjacent to the platen roller 10 when the opening and closing cover 3 is set in the closed state. A plurality of heating resistors (heating elements), configured to generate heat by electric conduction, are disposed on the printing surface of the thermal head 28 while being aligned along the width direction (short-side direction) of the label continuous body P. The circuit board 32 is a wiring board configured to transmit a print signal to the thermal head 28.

The coil spring 29 is configured to bias the head bracket 27 and the thermal head 28 toward the platen roller 10 when the opening and closing cover 3 is set in the closed state. The coil spring 29 is disposed on the back surface of the head bracket 27 (the back side of the surface to which the circuit board 32 is disposed). The head bracket 27 is pressed toward the platen roller 10 by the biasing force of the coil spring 29. Hence, the platen roller shaft 10*a*, fitted into the groove of the head bracket 27, is also pressed and thereby the holding of the opening and closing cover 3 by the head bracket 27 is maintained.

The feed plate 30 is configured to form the paper path for feeding, toward the platen roller 10, a part unwound in a sheet shape from the label continuous body P (see FIG. 2) accommodated in the paper container 6 (note: the feed plate 30 will be described below). The battery container is configured to accommodate a battery for driving the printer 1. The battery container is configured to be opened and closed by the aforementioned battery cover 8 (see FIG. 2). A lithium-ion battery, for instance, is herein used as the battery.

Figure 4:
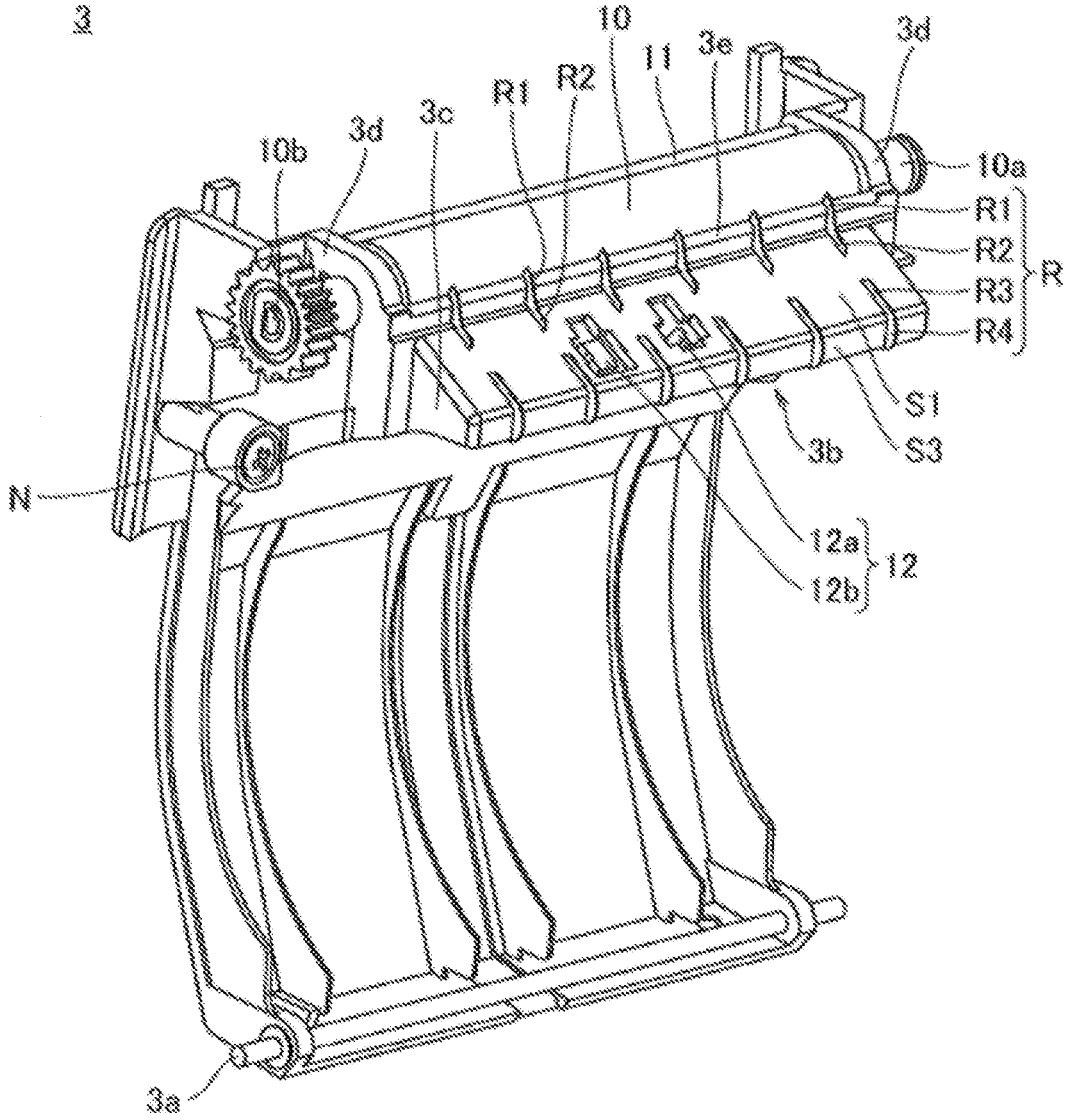
FIG. 4 is a perspective view of the opening and closing cover as seen from a gear side.
Figure 5:
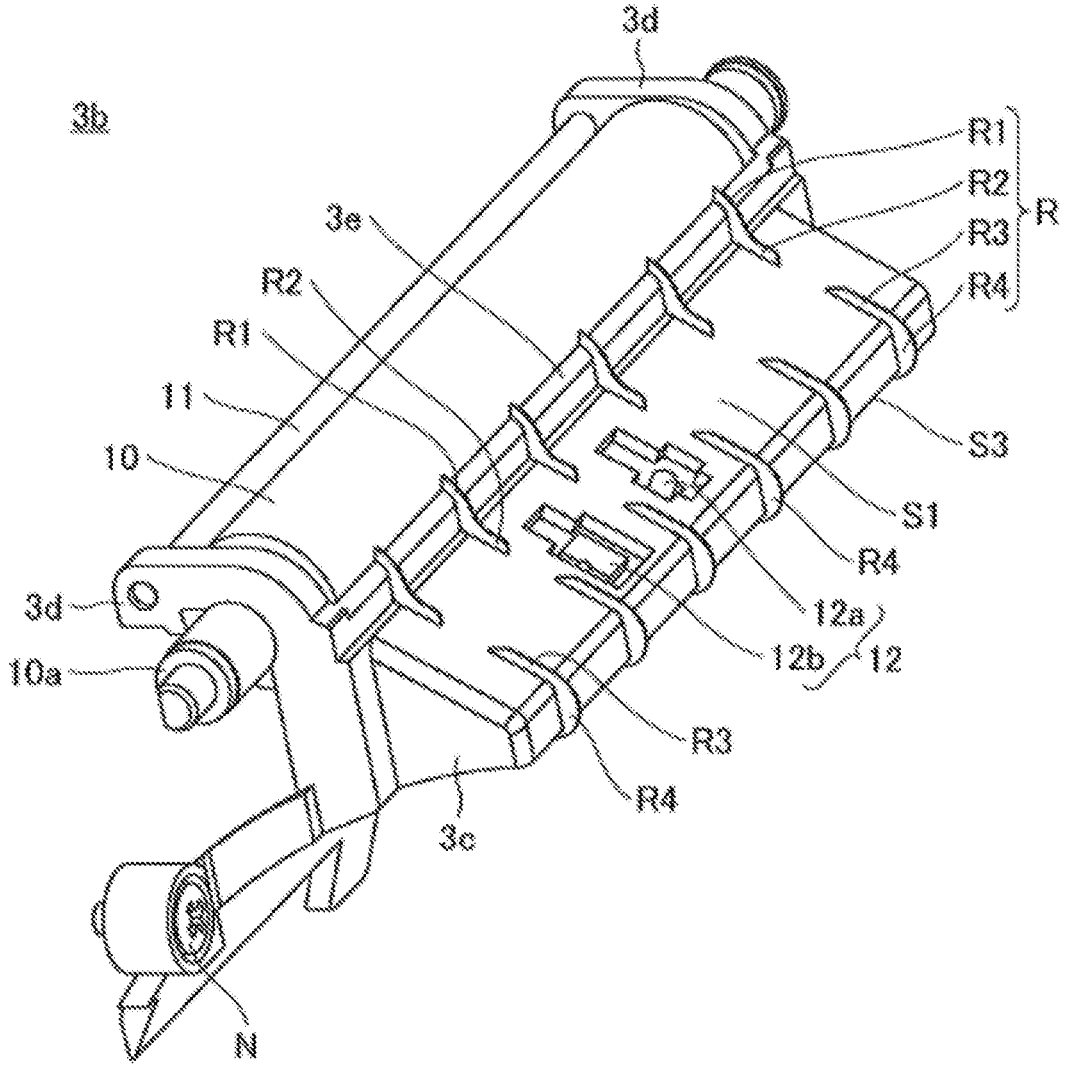
FIG. 5 is an enlarged perspective view of a protruding head of the opening and closing cover shown in FIG. 4.
Figure 6:
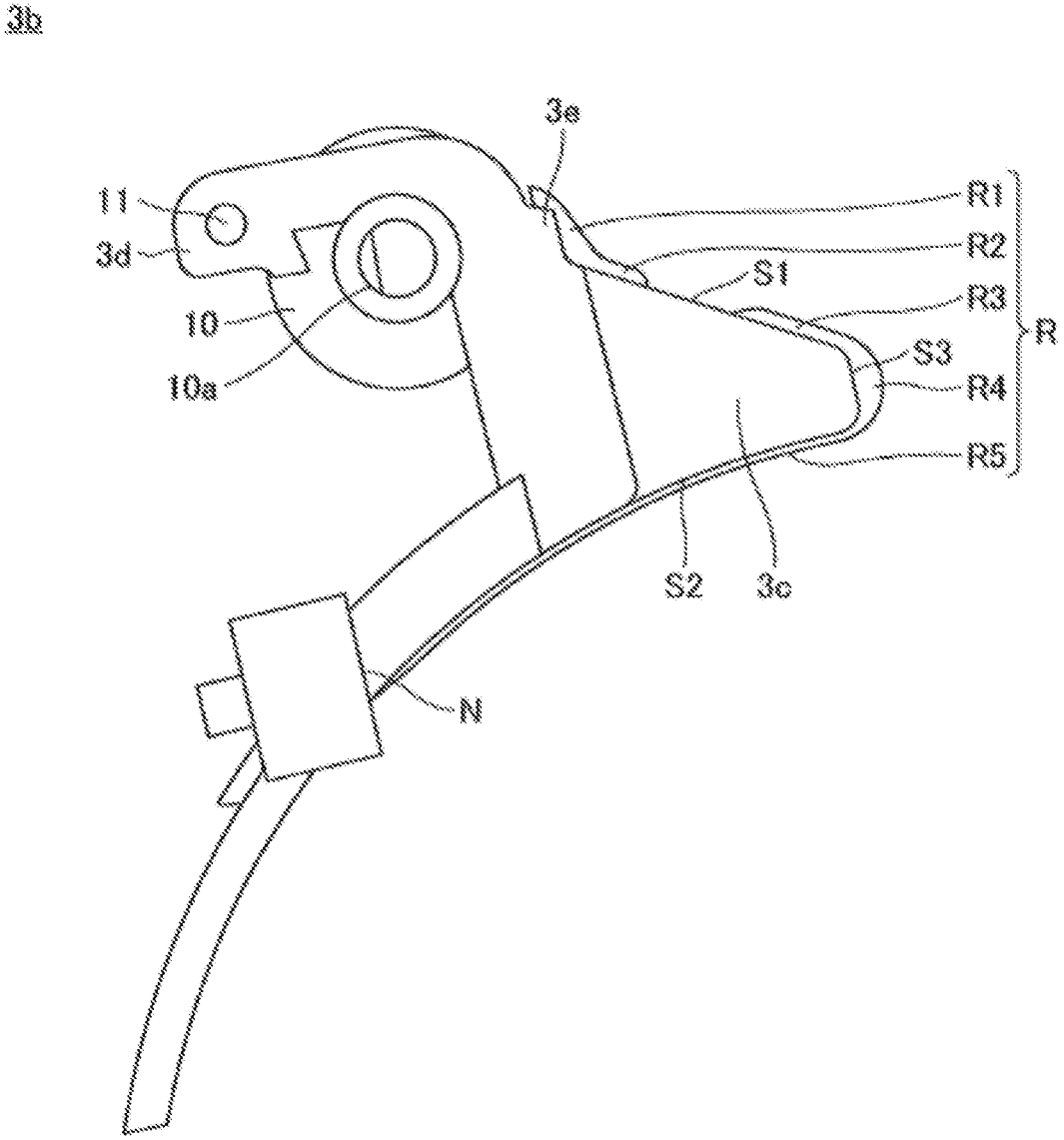
FIG. 6 is a side view of the opening and closing cover shown in FIG. 5.
Figure 7:
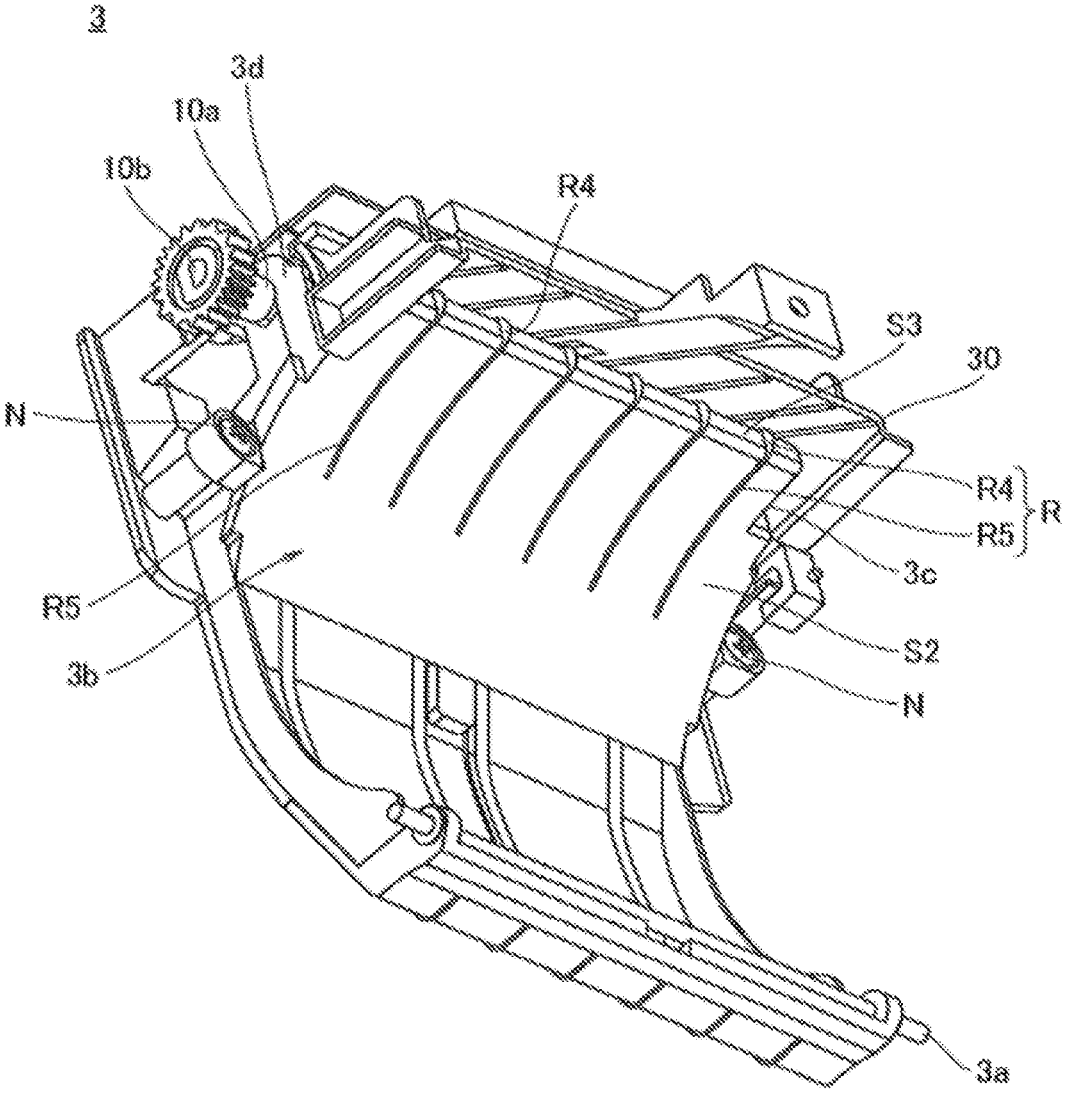
FIG. 7 is a perspective view of the opening and closing cover as seen from a paper container side.

The structure of the opening and closing cover 3 will be explained with reference to FIGS. 4 to 7. FIG. 4 is a perspective view of the opening and closing cover as seen from the gear 10*b* side. FIG. 5 is an enlarged perspective view of a protruding head of the opening and closing cover. FIG. 6 is a side view of the opening and closing cover shown in FIG. 5. FIG. 7 is a perspective view of the opening and closing cover as seen from the paper container side.

An inner cover 3*b* is detachably attached to the back side of the free end of the opening and closing cover 3 by screws N. The inner cover 3*b* is integrally provided with a protruding head 3*c*. The protruding head 3*c* protrudes in a separating direction from the platen roller 10 disposed on the free end of the opening and closing cover 3. The protruding head 3*c* has a thickness gradually reducing in the separating direction from the platen roller 10. The protruding head 3*c* is integrally provided with holding parts 3*d* on the platen roller 10 side thereof. The holding parts 3*d* are disposed on the both lengthwise ends of the platen roller 10. The holding parts 3*d* bend to enclose part of the outer periphery of the platen roller shaft 10*a*. The platen roller shaft 10*a* (i.e., the platen roller 10) is rotatably held by the holding parts 3*d*. Thus, the protruding head 3*c* is herein integrally provided with the member for holding the platen roller shaft 10*a* (the platen roller 10). Hence, compared to a construction that the member for holding the platen roller shaft 10*a* (the platen roller 10) is separately provided, the number of components can be reduced, and thereby, the printer 1 can be reduced in size and also in cost.

The protruding head 3*c* includes a first surface S1, a second surface S2 located on the back side of the first surface S1, and a third surface S3 (exemplary connecting part) located on the tip of the protruding head 3*c*. The first surface S1 is an internal wall surface configured to form the paper path of a part unwound in a sheet shape from the label continuous body P (feeding path in feeding and back feeding). The first surface S1 opposes the adhesive agent layer of a part unwound in a sheet shape from the label continuous body P when the opening and closing cover 3 is set in the closed state. The aforementioned sensor 12 is disposed on the first surface S1. The protruding head 3*c* is integrally provided with a protruding part 3*e* on the platen roller 10—side end of the first surface S1 thereof. The protruding part 3*e* protrudes in an intersecting direction with the first surface S1, while facing part of the outer periphery of the platen roller 10 from end to end in the lengthwise direction of the platen roller 10.

The second surface S2 is an inner wall surface that is adjacent to the paper container 6 (i.e., the outer periphery of the label continuous body P wound in a roll shape) when the opening and closing cover 3 is set in the closed state. For example, the second surface S2 has a curved shape along the outer periphery of the label continuous body P wound in a roll shape. The third surface S3 is an inner wall surface configured to connect the first surface S1 and the second surface S2. The extension of the third surface S3 intersects with that of the first surface S1 and that of the second surface S2. The third surface S3 has, for instance, an approximately flat shape. It should be noted that the shape of the third surface S3 is not limited to the flat shape and may be a curved shape.

The protruding head 3*c* includes a plurality of ribs R on its surface (the surface of the protruding part 3*e*, the first surface S1, the second surface S2 and the third surface S3). The ribs R extend in intersecting directions with the lengthwise direction of the platen roller 10 while being aligned at predetermined intervals along the lengthwise direction of the platen roller 10. Each rib R includes a first rib part R1 (exemplary first ridge part), a second rib part R2 (exemplary second ridge part), a third rib part R3 (exemplary third ridge part), a fourth rib part R4 (exemplary fourth ridge part) and a fifth rib part R5 (exemplary fifth ridge part).

When seen from a lateral side of the opening and closing cover 3, the first rib part R1 of each rib R protrudes from the surface of the protruding part 3*e*. When seen toward the first surface S1, the first rib part R1 extends in an intersecting direction with the lengthwise direction of the platen roller 10. In the extending direction of the first rib part R1, the platen roller 10—side end of the first rib part R1 ends in a shape sharpened toward the tip, whereas the first surface S1—side end continuously connects with the second rib part R2.

The aforementioned protruding part 3*e* is disposed on the both sides of the first rib part R1 in the width direction (short-side direction). The protruding part 3*e* is configured to reduce the aspect ratio of the first rib part R1 as described below, and also has a reinforcement function of enhancing the mechanical strength of the first rib part R1 by holding the both sides of the leg of the first rib part R1 in the width direction.

When seen from the lateral side of the opening and closing cover 3, the second rib part R2 of each rib R protrudes from the first surface S1. The second rib part R2 is disposed in the vicinity of the protruding part 3*e*. When seen toward the first surface S1, the second rib part R2 also extends in the intersecting direction with the lengthwise direction of the platen roller 10. In the extending direction of the second rib part R2, the end of the second rib part R2 ends in a position between the platen roller 10 and the third surface S3.

When seen from the lateral side of the opening and closing cover 3, the third rib part R3 of each rib R protrudes from the first surface S1. When seen toward the first surface S1, the third rib part R3 also extends along the feeding direction of the label continuous body P. The third rib part R3 is disposed on the extension of the second rib part R2. However, the third rib part R3 is disposed in the vicinity of the third surface S3 located away from the second rib part R2 without continuously connecting with the second rib part R2. In other words, a region without the ribs R exists between the second rib part R2 and the third rib part R3. Thus, each rib R, extending along the feeding direction of the label continuous body P, is divided in a region between the platen roller 10 and the third surface S3 on the first surface S1 of the protruding head 3*c* of the opening and closing cover 3.

When seen from the lateral side of the opening and closing cover 3, the fourth rib part R4 of each rib R protrudes from the third surface S3 that is the tip surface of the protruding head 3*c*. When seen toward the third surface S3, the fourth rib part R4 also extends along the feeding direction of the label continuous body P. In the extending direction of the fourth rib part R4, one end of the fourth rib part R4 continuously connects with the third rib part R3 on the first surface S1, whereas the other end thereof continuously connects with the fifth rib part R5 on the second surface S2. The protruding length (protruding height) of fourth rib part R4 is longer (higher) than that of the first rib part R1, the second rib part R2, the third rib part R3 and the fifth rib part R5. With this construction, in feeding the label continuous body P, a part unwound in a sheet shape from the label continuous body P is fed while being supported at two contact points (two locations), composed of the platen roller 10 and the fourth rib parts R4, in a range between the platen roller 10 and the third surface S3.

When seen from the lateral side of the opening and closing cover 3, the fifth rib part R5 of each rib R protrudes from the second surface S2. The protruding length (protruding height) of the fifth rib part R5 is shorter (lower) than that of the first rib part R1, the second rib part R2 and the third rib part R3. When seen toward the second surface S2, the fifth rib part R5 extends along the rotational direction of the label continuous body P wound in a roll shape. With the fifth rib parts R5 herein provided, when the label continuous body P wound in a roll shape rotates within the paper container 6, the outer periphery of the label continuous body P is only allowed to make contact with a lesser number of parts (substantially contact with the fifth rib parts R5) of the second surface S2. Hence, it is possible to reduce frictional resistance occurring in rotation of the label continuous body P wound in a roll shape.

Figure 8:
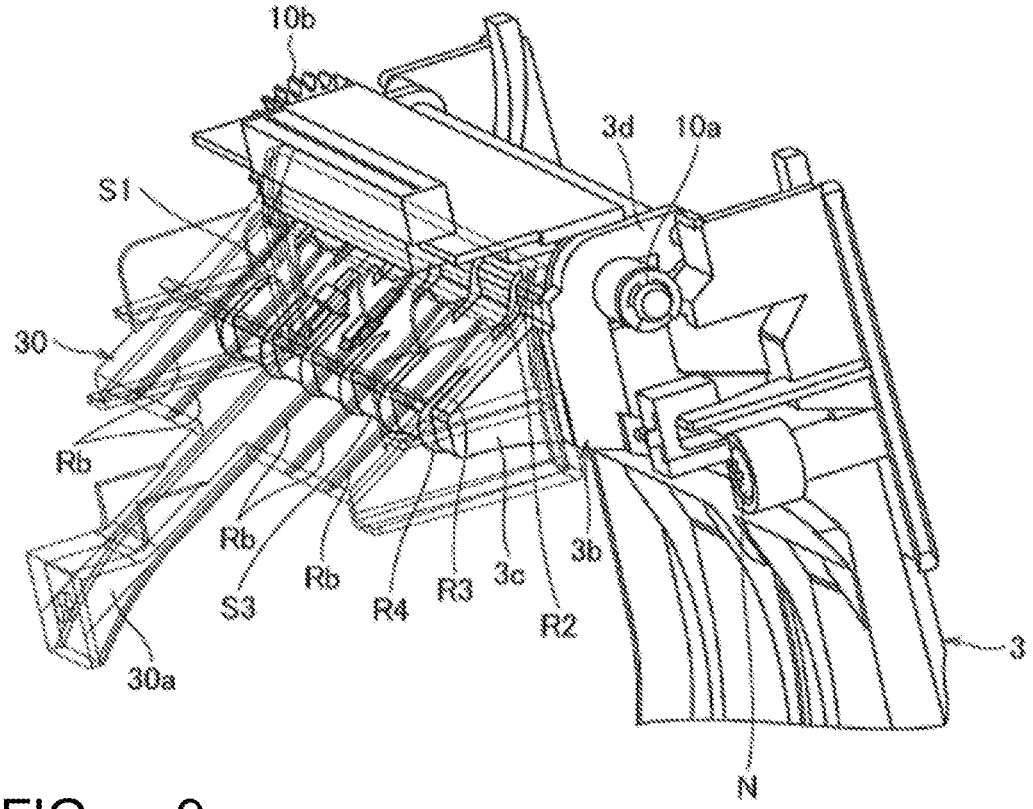
FIG. 8 is a perspective view of major elements of the opening and closing cover and a feed plate.
Figure 9:
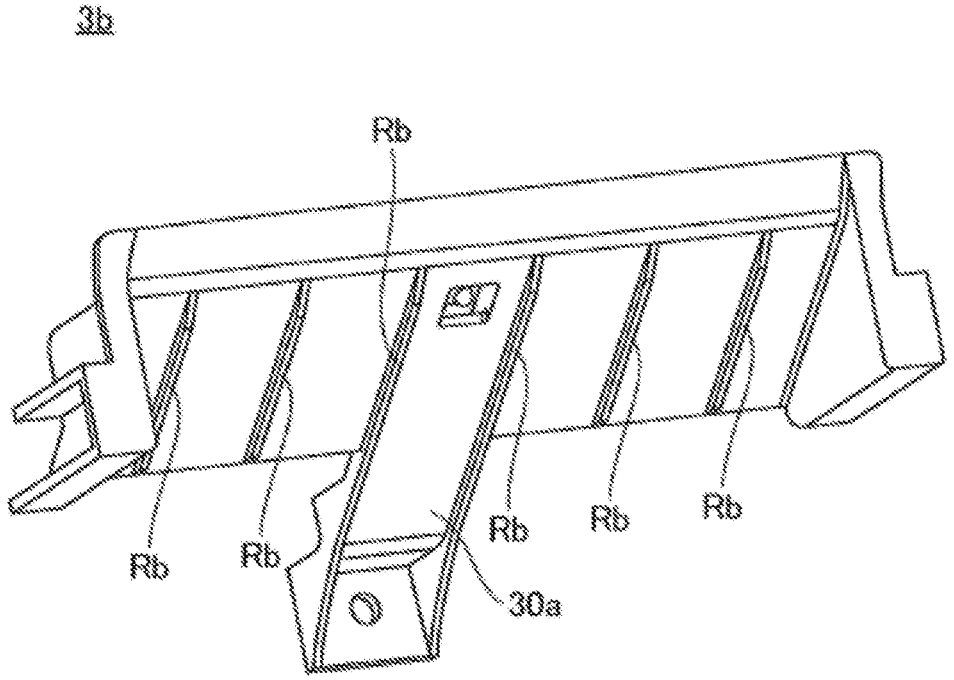
FIG. 9 is a perspective view of the feed plate as seen from a side that is adjacent to a first surface of the protruding head of the opening and closing cover in a closed state of the opening and closing cover.
Figure 10:
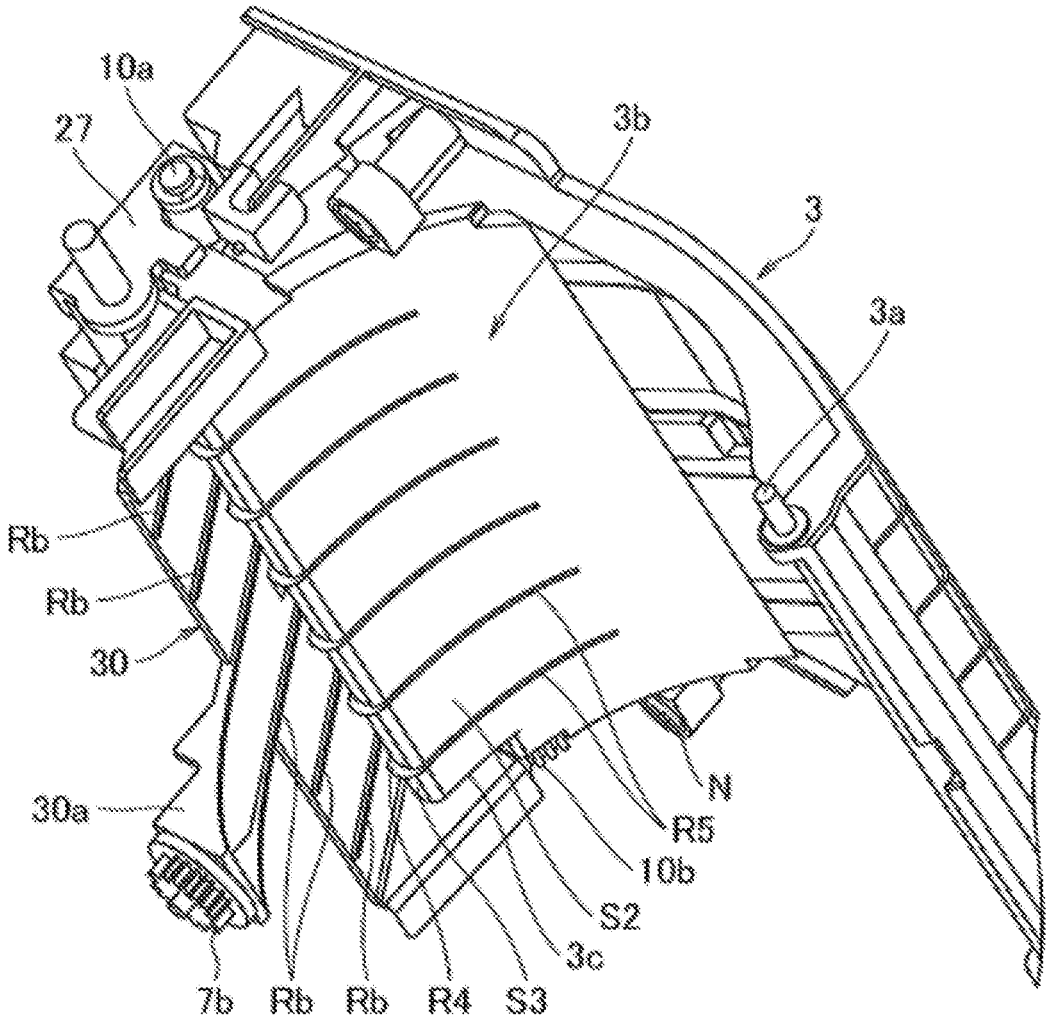
FIG. 10 is a perspective view of the opening and closing cover and the feed plate as seen from below.
Figure 11:
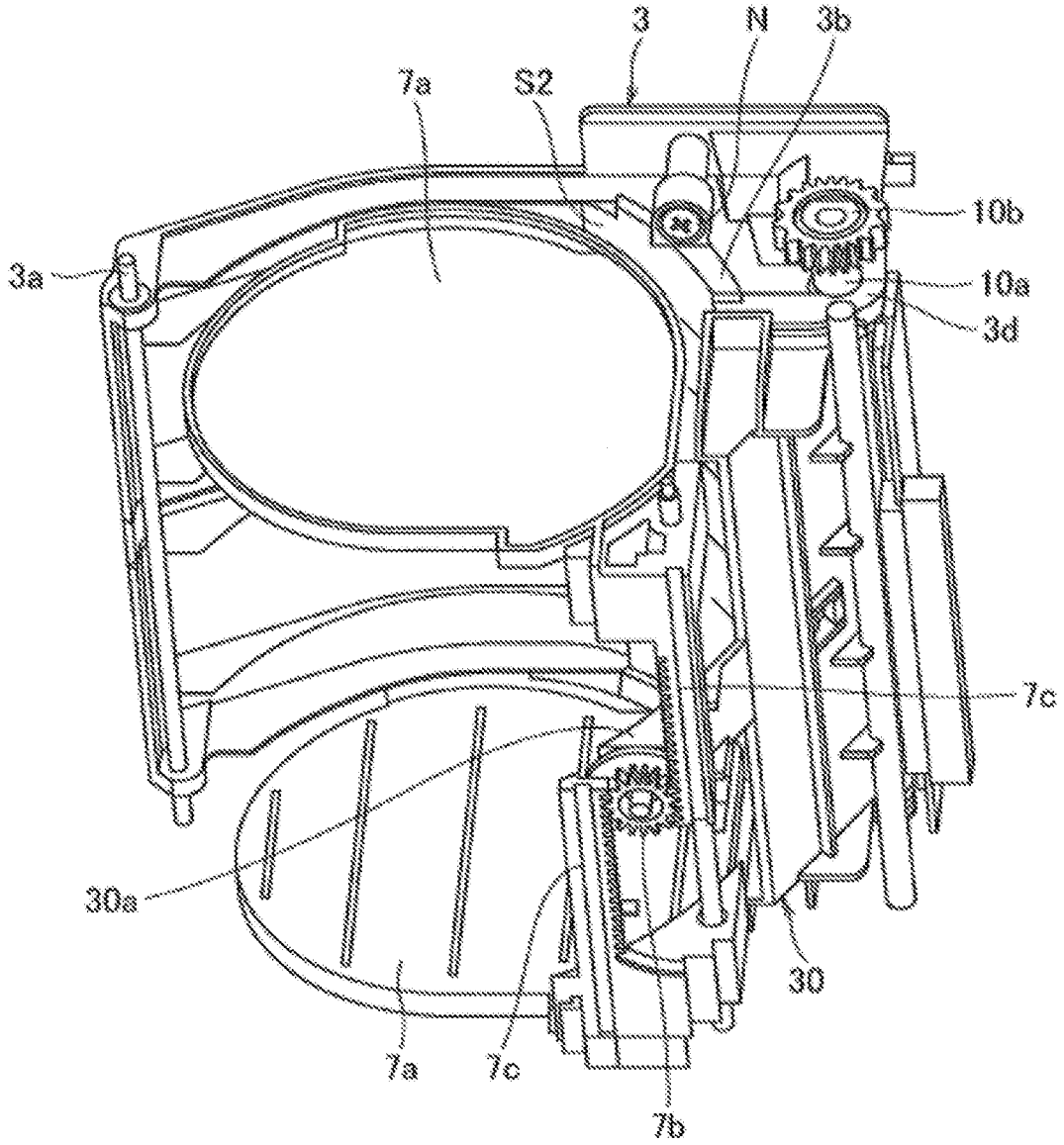
FIG. 11 is a perspective view of the opening and closing cover, the feed plate and a paper guide mechanism as seen from below.

The structure of the feed plate 30 of the printer 1 will be explained with reference to FIGS. 8 to 11. FIG. 8 is a perspective view of major elements of the opening and closing cover and the feed plate. FIG. 9 is a perspective view of the feed plate as seen from a side that is adjacent to the first surface of the protruding head of the opening and closing cover in a closed state of the opening and closing cover. FIG. 10 is a perspective view of the opening and closing cover and the feed plate as seen from below. FIG. 11 is a perspective view of the opening and closing cover, the feed plate and the paper guide mechanism as seen from below. FIG. 8 illustrates the feed plate 30 in a transparent representation in order to show how the feed plate 30 and the protruding head 3*c* face each other.

When the opening and closing cover 3 is set in the closed state, the feed plate 30 is detachably screwed to the opening and closing cover 3 while facing the first surface S1 of the protruding head 3*c* of the opening and closing cover 3. The feed plate 30 includes a plurality of ribs Rb (exemplary sixth ridge parts) disposed on the surface thereof. The surface of the feed plate 30 is adjacent to the first surface S1 of the protruding head 3*c*. The ribs Rb extend in the intersecting direction with the lengthwise direction of the platen roller 10 while being aligned at predetermined intervals along the lengthwise direction of the platen roller 10. The ribs Rb on the feed plate 30 are respectively disposed just in front of the ribs R on the first surface S1 of the protruding head 3*c* in front of the feed plate 30. With this construction, it is possible to match the contact positions between the ribs R and the label continuous body P with those between the ribs Rb and the label continuous body P. Hence, it is possible to match positions of traces formed on the label continuous body P by the contact with the ribs R with those of traces formed on the label continuous body P by the contact with the ribs Rb. Therefore, it is possible to reduce the number of lines left on the label continuous body P as traces of the ribs, compared to a construction that the ribs R and the ribs Rb are displaced without facing each other.

The feed plate 30 includes a support piece 30*a* disposed on approximately the middle of a lower edge (located on the bottom side in the body case 2) in the width direction (the lengthwise direction of the platen roller 10). The support piece 30*a* extends from part of the lower edge of the feed plate 30 toward the bottom surface in the interior of the body case 2. As shown in FIGS. 10 and 11, the support piece 30*a* includes a pinion gear 7*b* (exemplary gear member) on the bottom surface of its tip. The pinion gear 7*b* is supported so as to rotate along the bottom surface in the interior of the body case 2. As shown in FIG. 11, the pair of the guide plates 7*a* includes a pair of racks 7*c* on the bottom parts thereof. The racks 7*c* extend toward each other in a band shape. The pair of racks 7*c* is disposed to interpose the pinion gear 7*b* therebetween, while a plurality of teeth on the longer edge of each rack 7*c* are engaged with those of the pinion gear 7*b*. With the construction, when one of the guide plates 7*a* is moved to one side in the width direction of the label continuous body P wound in a roll shape, the other of the guide plates 7*a* is oppositely moved to the other side in the width direction of the label continuous body P by the action of the pinion gear 7*b* and the racks 7*c*. With the construction that the pinion gear 7*b* is disposed on the support piece 30*a* on the lower part of the feed plate 30, the printer 1 can be produced in smaller size than by a construction that the pinion gear 6*b* is disposed on the bottom surface in the interior of the body case 2.

Figure 12:
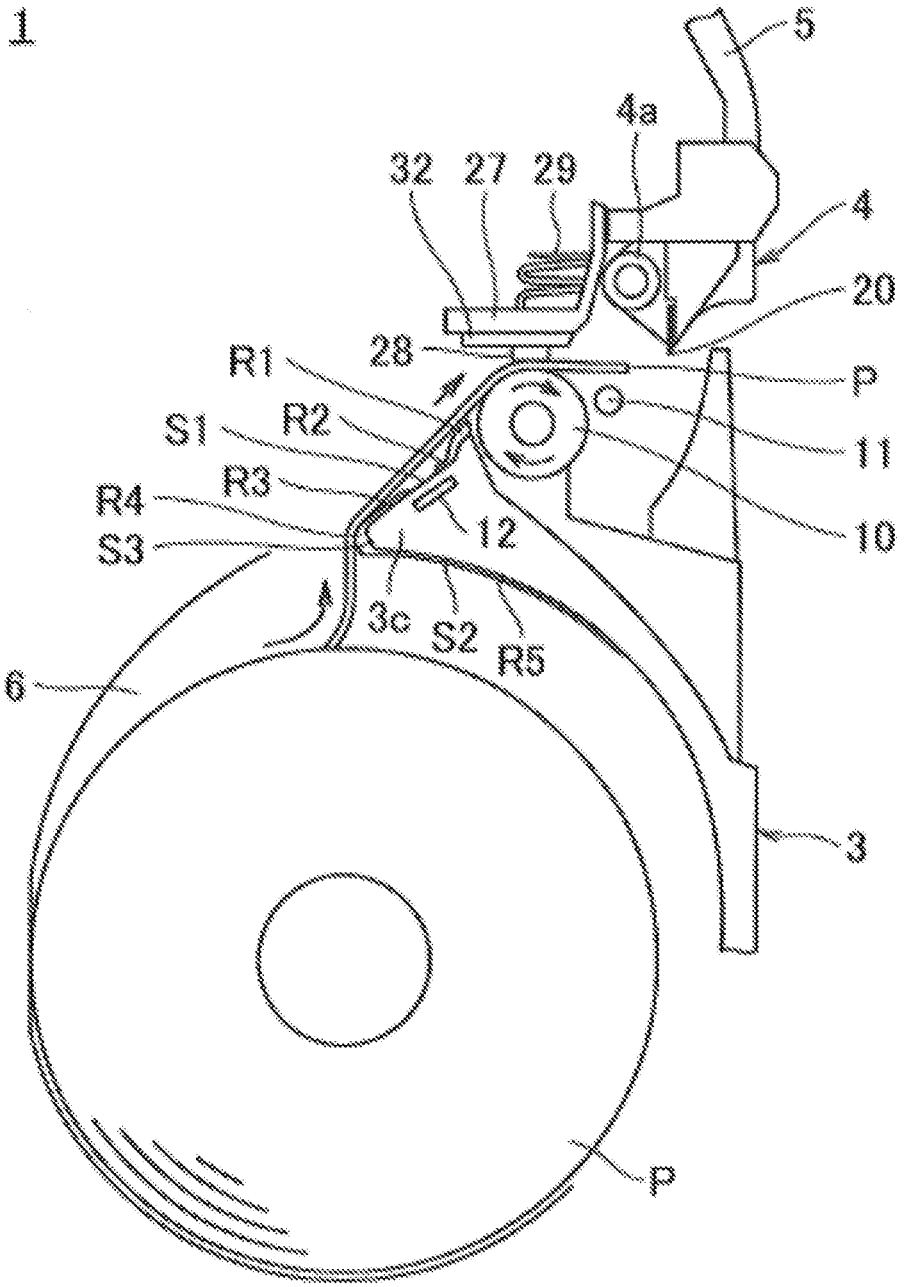
FIG. 12 is a schematic configuration diagram of the printer shown in FIGS. 1A and 1B in a printing step as seen from a lateral side.
Figure 13:
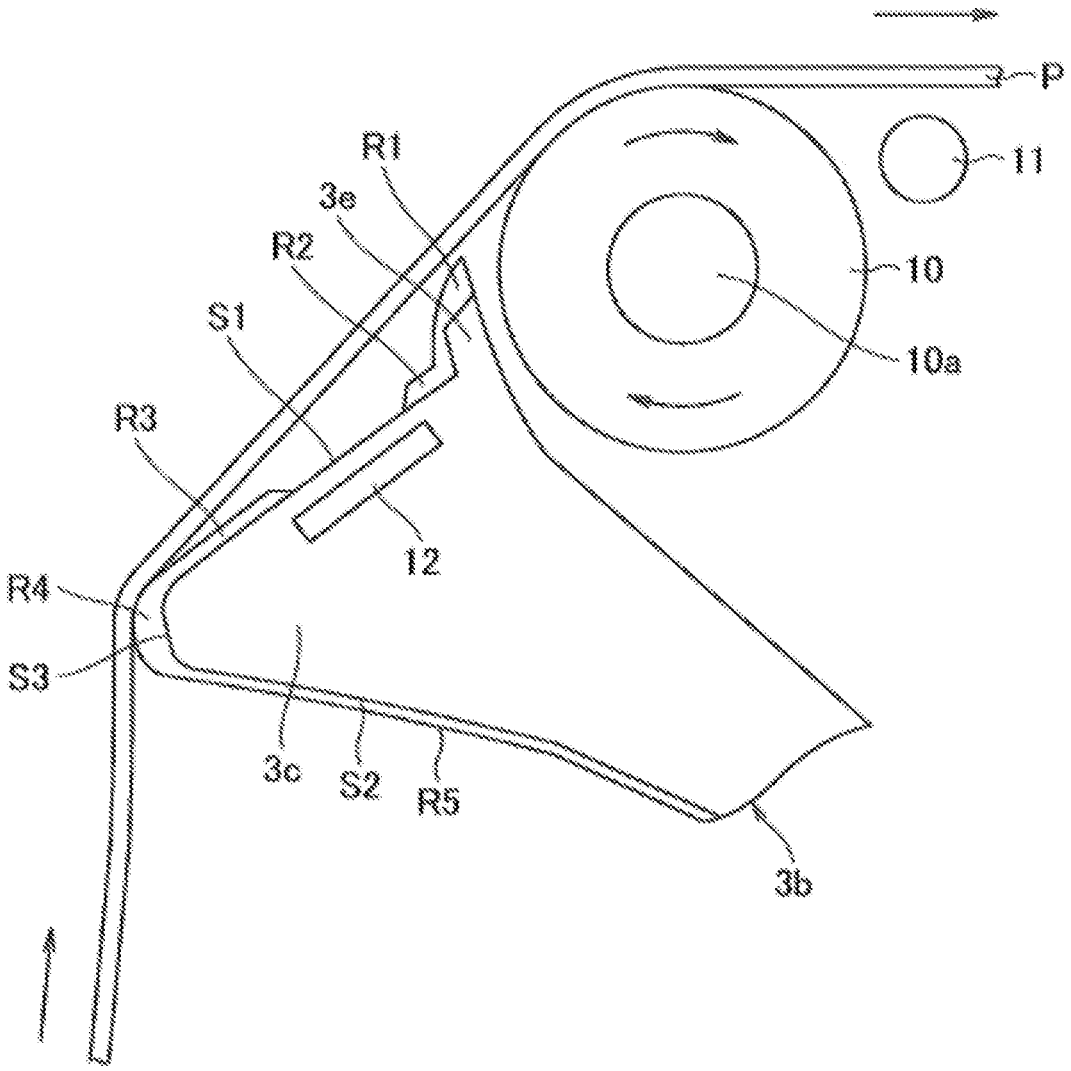
FIG. 13 is an enlarged schematic configuration diagram of major elements of the printer shown in FIG. 12.

An exemplary method of printing by the printer 1 will be explained with reference to FIGS. 12 to 18. FIG. 12 is a schematic configuration diagram of the printer shown in FIGS. 1A and 1B in a printing step as seen from a lateral side. FIG. 13 is an enlarged schematic configuration diagram of major elements of the printer shown in FIG. 12. FIGS. 12 to 18 show an exemplary situation that the printer 1 is used in the vertical installation.

As shown in FIG. 12, a part unwound in a sheet shape from the label continuous body P accommodated in the paper container 6 is herein pinched between the thermal head 28 and the platen roller 10 through the fourth rib parts R4 on the tip of the protruding head 3*c* of the opening and closing cover 3. In this case, the adhesive agent layer of the part unwound in a sheet shape from the label continuous body P opposes the platen roller 10 and the first surface S1 of the opening and closing cover 3 without being covered. By rotating the platen roller 10 under this condition, the part unwound in a sheet shape from the label continuous body P is fed in the feeding direction. Intended information is printed on the thermal labels of the label continuous body P at printing timing, set based on a timing signal detected by the sensor 12, by causing the heating resistors of the thermal head 28 to heat and scan in response to a print signal transmitted to the thermal head 28. With the protruding tip of the protruding head 3*c* of the opening and closing cover 3, the part unwound in a sheet shape from the label continuous body P wound in a roll shape can be successfully separated from the label continuous body P regardless of the size of the label continuous body P, while being fed from the paper container 6 through the fourth rib parts R4 on the tip of the protruding head 3*c* to the gap between the thermal head 28 and the platen roller 10, both of which are located downstream in the feeding direction.

As shown in FIGS. 12 and 13, the adhesive agent layer of the part unwound in a sheet shape from the label continuous body P accommodated in the paper container 6 is fed while making contact with the fourth rib parts R4 on the tip (the third surface S3) of the protruding head 3*c* of the opening and closing cover 3. In other words, with the fourth rib parts R4 herein disposed, the adhesive agent layer of the label continuous body P is allowed to limitedly make contact with the fourth rib parts R4 on the third surface S3. Therefore, it is possible to reduce contact resistance occurring when the adhesive agent layer of the part unwound in a sheet shape from the label continuous body P makes contact with the third surface S3 in feeding. It is thereby possible to inhibit or prevent occurrence of printing defects attributed to this contact of the adhesive agent layer. Additionally, the adhesive agent layer of the part unwound in a sheet shape from the label continuous body P can be inhibited or prevented from sticking to the third surface S3 in feeding. Hence, it is possible to inhibit or prevent occurrence of jam attributed to this sticking of the adhesive agent layer. Moreover, the part unwound in a sheet shape from the label continuous body P can be smoothly fed, and power for feeding the label continuous body P can be reduced. Hence, battery consumption of the printer 1 can be reduced.

Protruding length (protruding height) of the fourth rib parts R4 is longer (higher) than that of the first rib parts R1, the second rib parts R2 and the third rib parts R3 on the first surface S1 of the protruding head 3*c* of the opening and closing cover 3. Hence, the part unwound in a sheet shape from the label continuous body P is supported at two contact points (two parts) composed of the fourth rib parts R4 and the platen roller 10. Normally in feeding, the adhesive agent layer of the part unwound in a sheet shape from the label continuous body P does not make contact with the first surface S1. However, even when the adhesive agent layer of the part unwound in a sheet shape from the label continuous body P approaches the first surface S1 in some operating situations, the adhesive agent layer is allowed to limitedly make contact with the first rib parts R1, the second rib parts R2 and the third rib parts R3 due to the aforementioned support structure with two contact points. Accordingly, the adhesive agent layer of the part unwound in a sheet shape from the label continuous body P can be inhibited or prevented from sticking to the first surface S1 in feeding. Hence, it is possible to inhibit or prevent occurrence of jam attributed to this sticking of the adhesive agent layer. Moreover, the part unwound in a sheet shape from the label continuous body P can be smoothly fed, and power for feeding the label continuous body P can be reduced. Hence, battery consumption of the printer 1 can be reduced.

Figure 14:
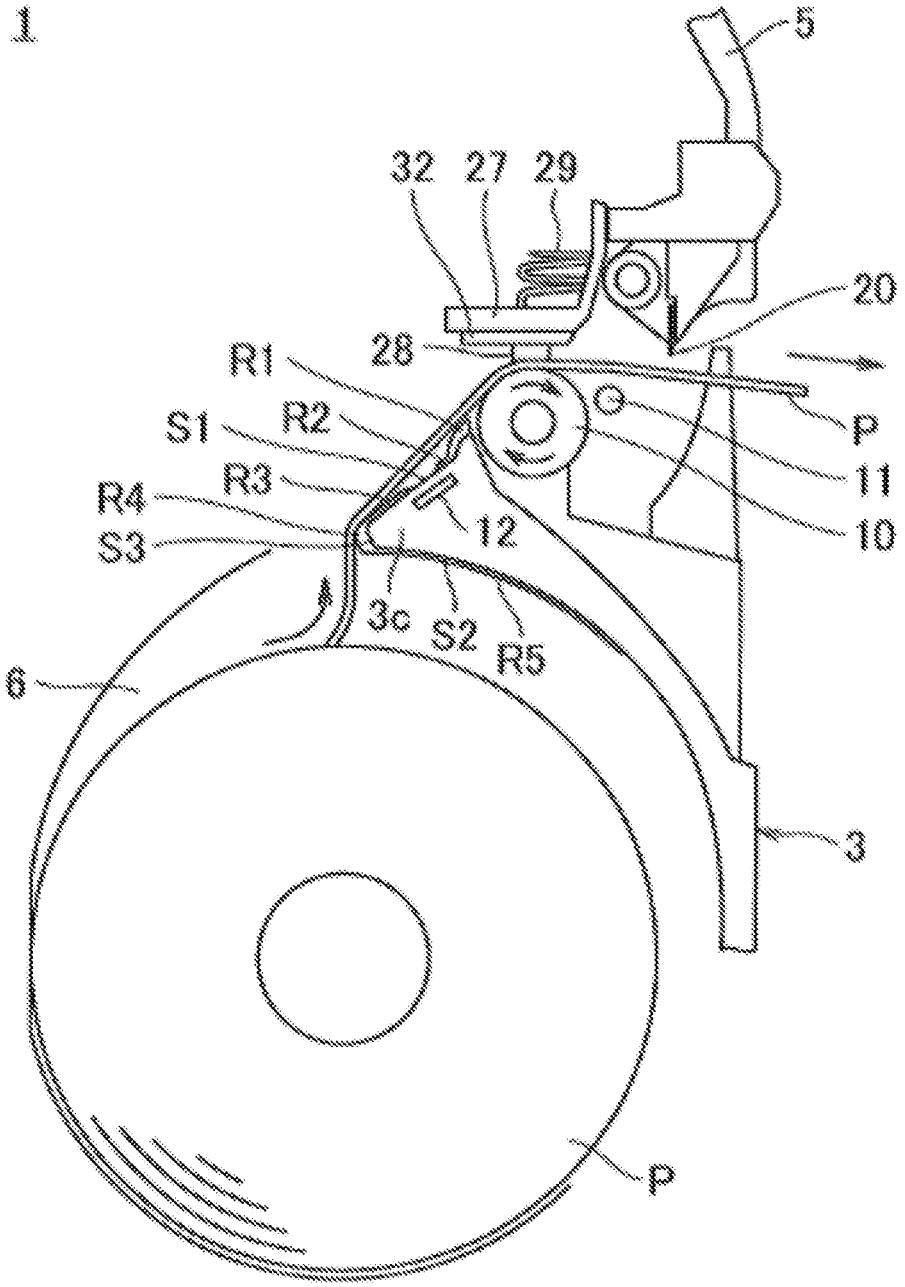
FIG. 14 is a schematic configuration diagram of the printer in another printing step subsequent to the printing step shown in FIG. 12 as seen from the lateral side.
Figure 15:
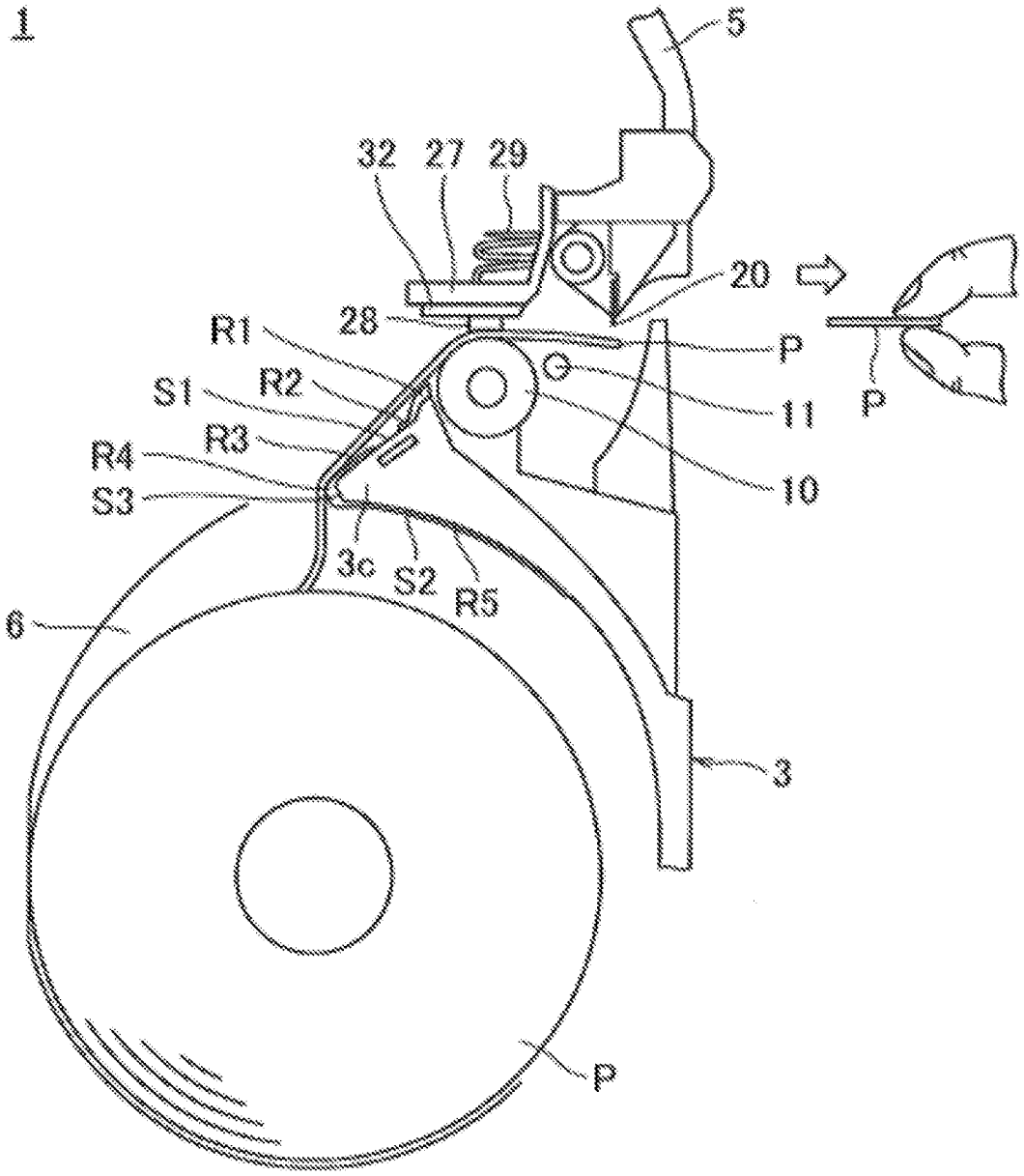
FIG. 15 is a schematic configuration diagram of the printer in yet another printing step subsequent to the printing step shown in FIG. 14 as seen from the lateral side.

FIG. 14 is a schematic configuration diagram of the printer in another printing step subsequent to the printing step shown in FIG. 12 as seen from the lateral side. FIG. 15 is a schematic configuration diagram of the printer in yet another printing step subsequent to the printing step shown in FIG. 14 as seen from the lateral side. As shown in FIG. 14, a printed label part of the label continuous body P is ejected to the outside through the ejection port of the printer 1. Thereafter, as shown in FIG. 15, the printed label part is cut off with the edge of the cutter 20, while being pinched by fingers.

Figure 16:
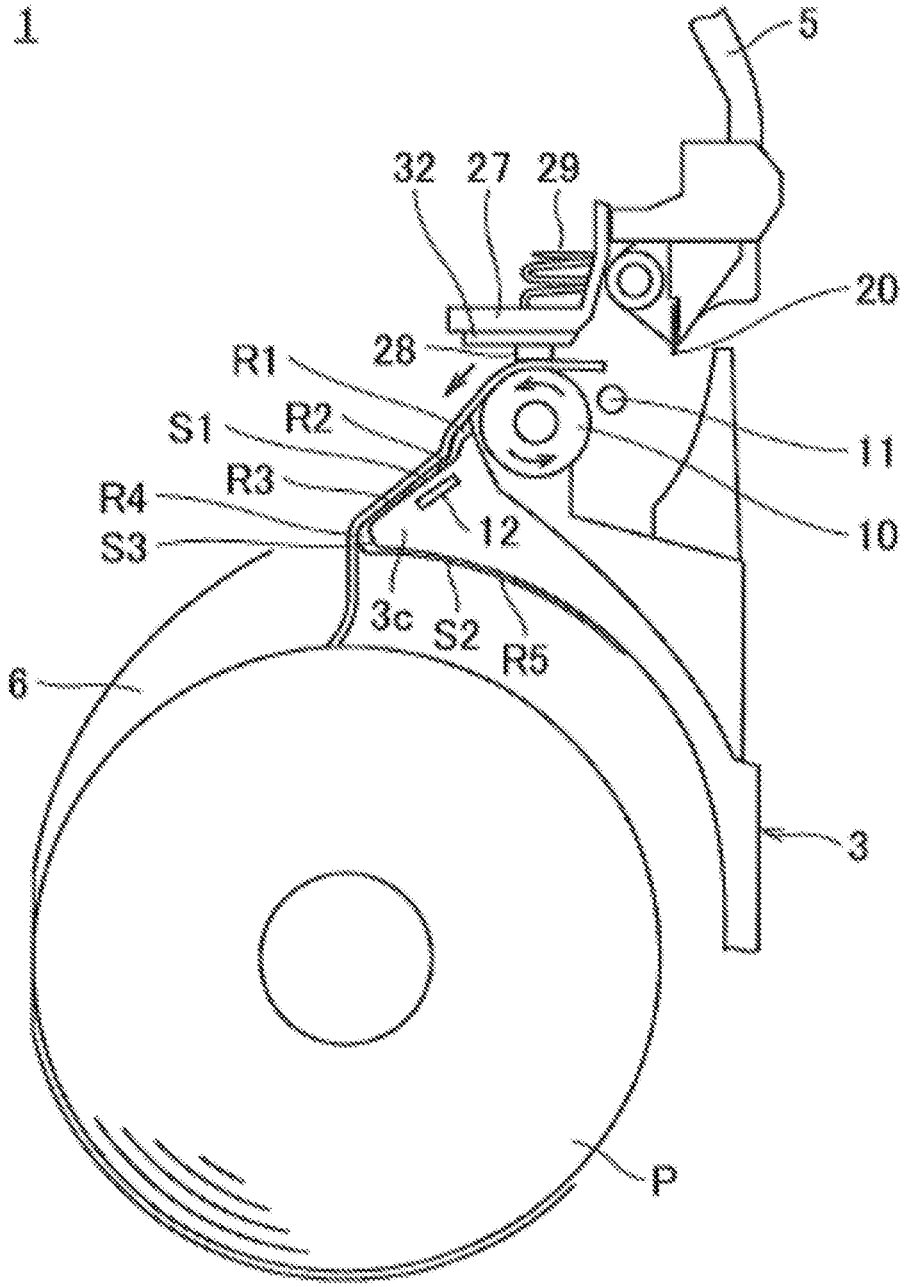
FIG. 16 is a schematic configuration diagram of the printer in a back feeding step as seen from the lateral side.
Figure 17:
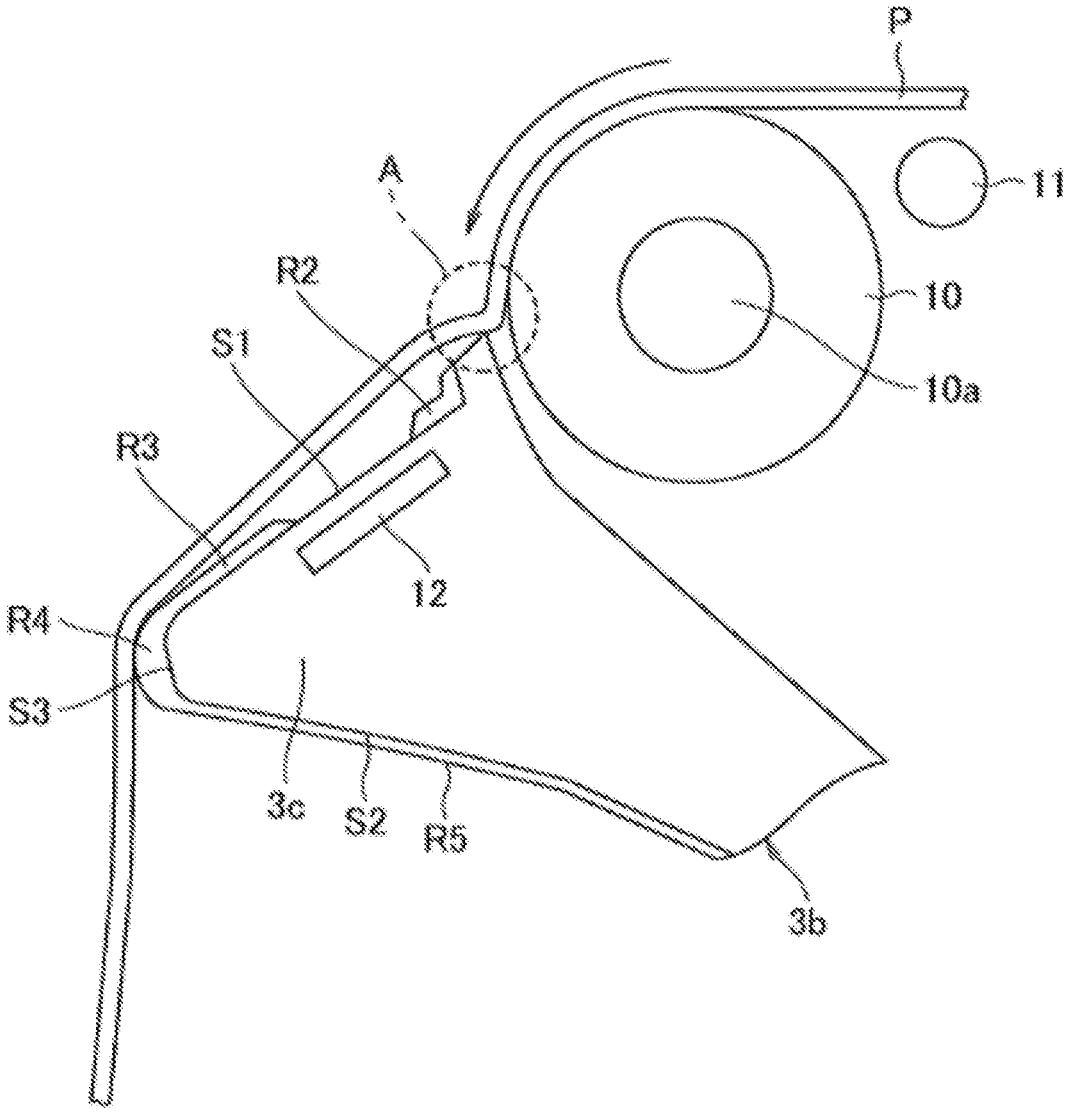
FIG. 17 is an enlarged schematic configuration diagram of major elements of a printer with a construction examined by the inventor of the present application in a back feeding step as seen from the lateral side.
Figure 18:
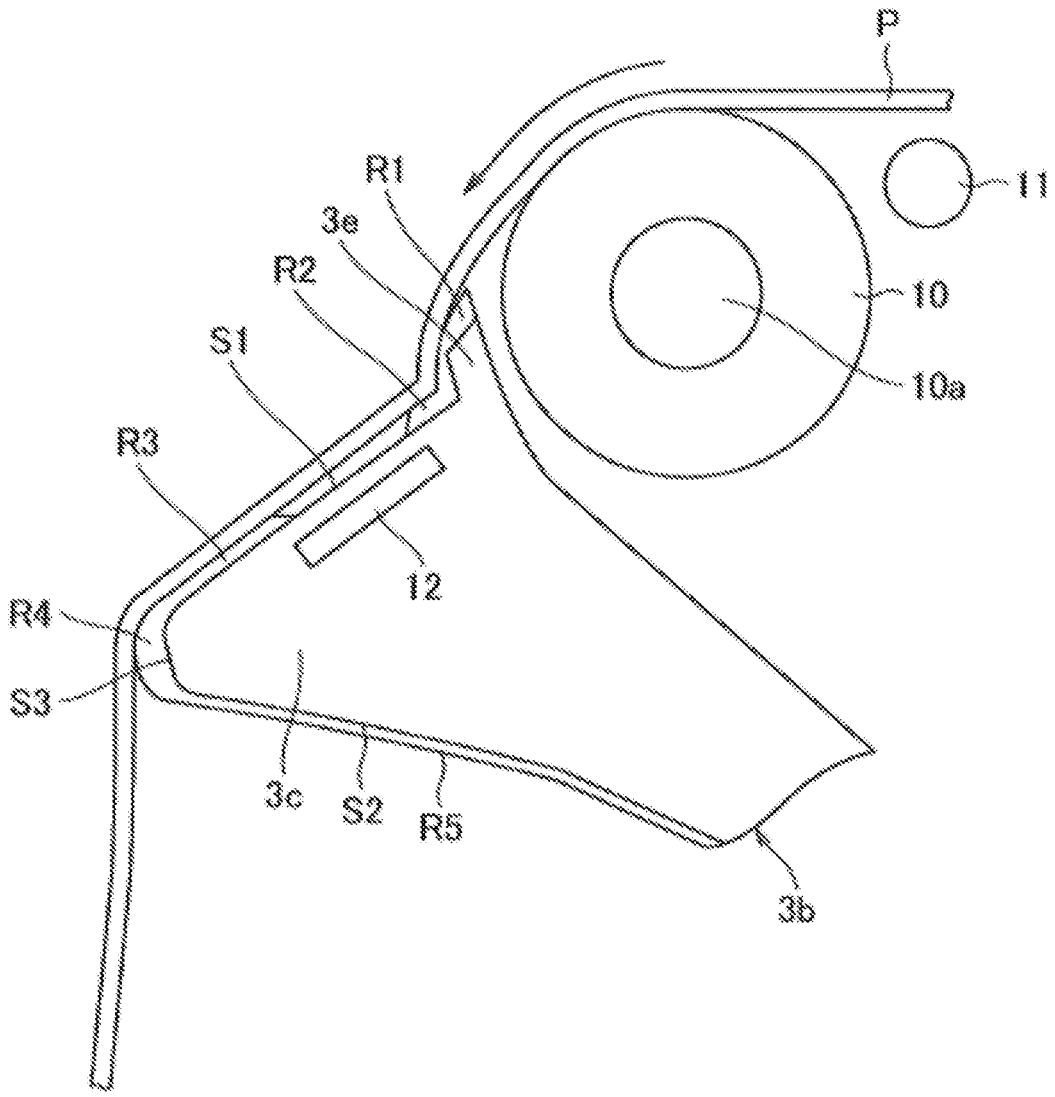
FIG. 18 is an enlarged schematic configuration diagram of major elements of the printer shown in FIG. 16.

FIG. 16 is a schematic configuration diagram of the printer in a back feeding step as seen from a lateral side. FIG. 17 is an enlarged schematic configuration diagram of major elements of a printer with a construction examined by the inventor of the present application in a back feeding step as seen from the lateral side. FIG. 18 is an enlarged schematic configuration diagram of major elements of the printer shown in FIG. 16.

As shown in FIG. 16, back feeding for a part unwound in a sheet shape from the label continuous body P returns a leading label part of the label continuous body P, located next to the cut-off printed label part, to the printing position (the thermal head 28 side).

As shown in FIG. 17, if the protruding head 3*c* of the opening and closing cover 3 does not include the first rib parts on the platen roller 10—side end of the first surface S1, this construction has the following risk in the back feeding step. That is to say, a part unwound in a sheet shape from the label continuous body P is drawn into a gap between the platen roller 10 and the protruding head 3*c* (region depicted with broken line A) when the part is fed from the position of the thermal head 28 toward the protruding head 3*c* while slightly sticking to the outer periphery of the platen roller 10. Then, the part sticks to the platen roller 10—side end of the protruding head 3*c*, and accordingly jam occurs. Especially, such sticking-related jam easily occurs when the linerless labels are interposed and held between the thermal head 28 and the platen roller 10 for a long period of time. By contrast, in the present exemplary embodiment, as shown in FIG. 18, a part unwound in a sheet shape from the label continuous body P can be separated from the outer periphery of the platen roller 10 by the first rib parts R1 when being fed from the position of the thermal head 28 toward the protruding head 3*c* while slightly sticking to the outer periphery of the platen roller 10. In this case, the part unwound in a sheet shape from the label continuous body P can be separated from the outer periphery of the platen roller 10 on the back-feeding directional upstream side (feeding directional downstream side) of the region depicted with broken line A in FIG. 17. Therefore, the part unwound in a sheet shape from the label continuous body P can be prevented from being drawn into the gap between the platen roller 10 and the protruding head 3*c*, and can be also prevented from sticking to the platen roller 10—side end of the protruding head 3*c*. Hence, occurrence of jam can be prevented in back feeding.

The height of the first rib parts R1 and the shape of the platen roller 10—side tip of the first rib parts R1 are designed from the perspective of the aforementioned label separation function. If the first rib parts R1 is disposed without the protruding part 3*e*, it is inevitable for the first rib parts R1 to have a large height and also have a high aspect ratio in order to achieve the aforementioned label separation function. Consequently, the mechanical strength of the first rib parts R1 deteriorates, and this may result in deformation of the first rib parts R1. By contrast, in the present exemplary embodiment, the protruding part 3*e* is disposed and thereby the height (and the aspect ratio) of the first rib parts R1 can be lowered than that in the construction without the protruding part 3*e*. Hence, the first rib parts R1 per se can be enhanced in mechanical strength. Additionally, the protruding part 3*e* is disposed on the both sides of the leg of each first rib part R1 in the width direction such that each first rib part R1 is interposed between adjacent regions of the protruding part 3*e*. Hence, the first rib parts 121 can be enhanced in mechanical strength. In other words, the protruding part 3*e* exerts a function of a reinforcement member for the first rib parts R1. Based on the above, deformation of the first rib parts R1 can be prevented.

In a back feeding step, the part unwound in a sheet shape from the label continuous body P sags in an approaching direction to the first surface S1 of the protruding head 3*c*. However, as shown in FIG. 18, the first surface S1 includes the first rib parts R1, the second rib parts R2 and the third rib parts R3. With this construction, the adhesive agent layer of the part unwound in a sheet shape from the label continuous body P is allowed to limitedly make contact with the first rib parts R1, the second rib parts R2 and the third rib parts R3. Accordingly, the adhesive agent layer of the part unwound in a sheet shape from the label continuous body P can be inhibited or prevented from sticking to the first surface S1 in the back feeding step. Hence, it is possible to inhibit or prevent occurrence of jam attributed to this sticking of the adhesive agent layer. Moreover, similarly in back feeding, the part unwound in a sheet shape from the label continuous body P can be smoothly fed, and power for feeding the label continuous body P can be reduced. Hence, battery consumption of the printer 1 can be reduced. Especially in the present exemplary embodiment, the second rib part R2 and the third rib part R3 are divided in each rib R. With this construction, it is even possible to reduce the area that the adhesive agent layer unwound in a sheet shape from the label continuous body P makes contact with the second rib parts R2 and the third rib parts R3 in the back feeding step. Therefore, it is possible to further enhance performance of feeding the label continuous body P in the back feeding step.

Based on the exemplary embodiment, the present invention made by the inventor of the present application has been specifically explained above. The exemplary embodiment disclosed in the present specification is exemplary only in all aspects and the present invention is not limited to the technology herein disclosed. In other words, the technical scope of the present invention should not be interpreted restrictively based on the explanation in the aforementioned detailed description, rather should be interpreted based on the description of claims, and encompasses equivalents of the technology described in the claims and all the changes made without departing from the gist of the claims.

For example, the aforementioned exemplary embodiment has explained that the present invention is applied to a dual mode printer usable for both of normal ejection and separation ejection. However, the application of the present invention is not limited to this, and is applicable to a printer usable exclusively for normal ejection.

Additionally, the aforementioned exemplary embodiment has explained that continuous labels (linerless labels) without a liner but include an adhesive agent layer on one surface thereof, are used as a print medium. However, the print medium is not limited to this. For example, a label continuous body that includes a plurality of labels temporarily attached to a long strip of liner (labels with a liner) or a continuously produced sheet without any adhesive agent layer (continuous sheet) is usable as the print medium, and not only a paper medium but also a film printable by a thermal head or so forth is usable as the print medium. The labels with a liner, the continuous sheet or the film can include location detection marks.

The invention claimed is:

1. A printer, comprising:

a housing;

a print medium container built in the housing, the print medium container configured to accommodate a print medium including an adhesive surface with an adhesive agent layer;

an opening and closing cover configured to open and close;

a feed roller disposed on the opening and closing cover;

a first surface opposing the adhesive surface of the print medium when the print medium is fed by the feed roller;

a second ridge part protruding from the first surface, the second ridge part extending in an intersecting direction with a lengthwise direction of the feed roller; and a third ridge part protruding from the first surface, the third ridge part being located on an extension of the second ridge part in the intersecting direction, the third ridge part being spaced apart from the second ridge part.

2. The printer according to claim 1, wherein the opening and closing cover includes a protruding head having a thickness that is gradually narrower in a direction away from the feed roller, the protruding head includes the first surface, a second surface, and a connecting part connecting the first surface and the second surface, the first surface opposing the adhesive agent layer of the print medium when the print medium is fed by the feed roller in a closed state of the opening and closing cover, the second surface being adjacent to the print medium container in the closed state of the opening and closing cover, the connecting part being disposed on a tip of the protruding head, the second ridge part ending in a position between the feed roller and the connecting part, the third ridge part being disposed on the first surface on a side thereof close to the connecting part.

3. The printer according to claim 2, further comprising a fourth ridge part protruding from a surface of the connecting part.

4. The printer according to claim 3, further comprising a fifth ridge part protruding from the second surface.

5. The printer according to claim 4, wherein the protruding head includes a holding part configured to hold the feed roller.

6. The printer according to claim 5, further comprising a protruding part disposed on the first surface, the protruding part being shaped to protrude adjacent to part of an outer periphery of the feed roller;

a first ridge part protruding from a surface of the protruding part;

a feed member configured to form a feeding path for the print medium in the housing, the feeding path being adjacent to the first surface in the closed state of the opening and closing cover; and the sixth ridge part protruding from the surface of the feed member at a position adjacent to the first surface.

7. The printer according to claim 6, further comprising a feed member configured to form a feeding path for the print medium in the housing, the feeding path being adjacent to the first surface in the closed state of the opening and closing cover;

a first guide member and a second guide member disposed inside the print medium container, the first guide member and the second guide member configured to guide a position of the print medium in a width direction of the print medium; and a gear member rotatably disposed on the feed member, the gear member configured to move the second guide member when the first guide member is moved in the width direction.

8. The printer according to claim 3, wherein the protruding head includes a holding part configured to hold the feed roller.

9. The printer according to claim 3, further comprising a protruding part disposed on the first surface, the protruding part being shaped to protrude adjacent to part of an outer periphery of the feed roller;

a first ridge part protruding from a surface of the protruding part;

a feed member configured to form a feeding path for the print medium in the housing, the feeding path being adjacent to the first surface in the closed state of the opening and closing cover; and the sixth ridge part protruding from the surface of the feed member at a position adjacent to the first surface.

10. The printer according to claim 3, further comprising a feed member configured to form a feeding path for the print medium in the housing, the feeding path being adjacent to the first surface in the closed state of the opening and closing cover;

a first guide member and a second guide member disposed inside the print medium container, the first guide member and the second guide member configured to guide a position of the print medium in a width direction of the print medium; and a gear member rotatably disposed on the feed member, the gear member configured to move the second guide member when the first guide member is moved in the width direction.

11. The printer according to claim 2, further comprising a fifth ridge part protruding from the second surface.

12. The printer according to claim 11, wherein the protruding head includes a holding part configured to hold the feed roller.

13. The printer according to claim 11, further comprising a protruding part disposed on the first surface, the protruding part being shaped to protrude adjacent to part of an outer periphery of the feed roller;

a first ridge part protruding from a surface of the protruding part;

a feed member configured to form a feeding path for the print medium in the housing, the feeding path being adjacent to the first surface in the closed state of the opening and closing cover; and the sixth ridge part protruding from the surface of the feed member at a position adjacent to the first surface.

14. The printer according to claim 11, further comprising a feed member configured to form a feeding path for the print medium in the housing, the feeding path being adjacent to the first surface in the closed state of the opening and closing cover;

a first guide member and a second guide member disposed inside the print medium container, the first guide member and the second guide member configured to guide a position of the print medium in a width direction of the print medium; and a gear member rotatably disposed on the feed member, the gear member configured to move the second guide member when the first guide member is moved in the width direction.

15. The printer according to claim 2, wherein the protruding head includes a holding part configured to hold the feed roller.

16. The printer according to claim 15, further comprising a protruding part disposed on the first surface, the protruding part being shaped to protrude adjacent to part of an outer periphery of the feed roller;

a first ridge part protruding from a surface of the protruding part;

a feed member configured to form a feeding path for the print medium in the housing, the feeding path being adjacent to the first surface in the closed state of the opening and closing cover; and the sixth ridge part protruding from the surface of the feed member at a position adjacent to the first surface.

17. The printer according to claim 15, further comprising a feed member configured to form a feeding path for the print medium in the housing, the feeding path being adjacent to the first surface in the closed state of the opening and closing cover;

a first guide member and a second guide member disposed inside the print medium container, the first guide member and the second guide member configured to guide a position of the print medium in a width direction of the print medium; and a gear member rotatably disposed on the feed member, the gear member configured to move the second guide member when the first guide member is moved in the width direction.

18. The printer according to claim 2, further comprising a protruding part disposed on the first surface, the protruding part protruding adjacent to part of an outer periphery of the feed roller;

a first ridge part protruding from a surface of the protruding part;

a feed member configured to form a feeding path for the print medium in the housing, the feeding path being adjacent to the first surface in the closed state of the opening and closing cover; and the sixth ridge part protruding from the surface of the feed member at a position adjacent to the first surface.

19. The printer according to claim 18, further comprising a feed member configured to form a feeding path for the print medium in the housing, the feeding path being adjacent to the first surface in the closed state of the opening and closing cover;

a first guide member and a second guide member disposed inside the print medium container, the first guide member and the second guide member configured to guide a position of the print medium in a width direction of the print medium; and a gear member rotatably disposed on the feed member, the gear member configured to move the second guide member when the first guide member is moved in the width direction.

20. The printer according to claim 2, further comprising a feed member configured to form a feeding path for the print medium in the housing, the feeding path being adjacent to the first surface in the closed state of the opening and closing cover;

a first guide member and a second guide member disposed inside the print medium container, the first guide member and the second guide member configured to guide a position of the print medium in a width direction of the print medium; and a gear member rotatably disposed on the feed member, the gear member configured to move the second guide member when the first guide member is moved in the width direction.

* * * * *